US009802096B2

(12) United States Patent
Simpson et al.

(10) Patent No.: US 9,802,096 B2
(45) Date of Patent: Oct. 31, 2017

(54) BADMINTON TRAINING AND CONDITIONING SYSTEM AND METHOD

(71) Applicants: David Simpson, Frederick, MD (US); Malik Basri, Silver Spring, MD (US)

(72) Inventors: David Simpson, Frederick, MD (US); Malik Basri, Silver Spring, MD (US)

( * ) Notice: Subject to any disclaimer, the term of this patent is extended or adjusted under 35 U.S.C. 154(b) by 247 days.

(21) Appl. No.: 14/745,943

(22) Filed: Jun. 22, 2015

(65) Prior Publication Data

US 2015/0367218 A1 Dec. 24, 2015

Related U.S. Application Data

(60) Provisional application No. 62/015,670, filed on Jun. 23, 2014.

(51) Int. Cl.

| | |
|---|---|
| ***A63F 9/24*** | (2006.01) |
| ***A63B 69/00*** | (2006.01) |
| ***A63B 71/06*** | (2006.01) |
| ***G06F 19/00*** | (2011.01) |
| *A63B 24/00* | (2006.01) |

(52) U.S. Cl.

CPC ..... *A63B 69/0017* (2013.01); *A63B 71/0619* (2013.01); *G06F 19/3481* (2013.01); *A63B 24/0075* (2013.01); *A63B 2208/0204* (2013.01)

(58) Field of Classification Search

CPC . A63B 2225/50; A63B 24/0003; A63B 69/38; A63B 2102/06; A63B 2102/065; A63B 69/0017

See application file for complete search history.

(56) References Cited

U.S. PATENT DOCUMENTS

| | | | | |
|---|---|---|---|---|
| 5,684,453 A * | 11/1997 | Welch | ..... | A63B 24/0021 340/323 R |
| 6,028,593 A | 2/2000 | Rosenberg et al. | | |
| 6,280,352 B1 * | 8/2001 | Coffeen | ..... | A63B 24/0021 434/248 |
| 6,366,272 B1 | 4/2002 | Rosenberg et al. | | |
| 6,430,997 B1 | 8/2002 | French et al. | | |

(Continued)

FOREIGN PATENT DOCUMENTS

| | | |
|---|---|---|
| CN | 201862234 U | 6/2011 |
| CN | 202020886 U | 11/2011 |

(Continued)

*Primary Examiner* — Steve Rowland

(74) *Attorney, Agent, or Firm* — Edell, Shapiro & Finnan, LLC

(57) ABSTRACT

A computerized software system helps badminton players improve their footwork and conditioning. The system reads information from stored training modules in a portable computing device. In one mode, the system displays an indicator arrow to one of six corners on a badminton court image. A player moves on a real badminton court or other suitable surface in the direction indicated by the arrow displayed on the badminton court image. The arrow represents a fake and is displayed randomly or in sequence to all six corners. The speed the arrow flashes from corner to corner is adjustable. In another mode, the system randomly displays an indicator symbol on an opposing badminton court image to indicate an area of the court a player is to return a fed bird. A user may select a training module having either timed training sets or count training sets.

21 Claims, 27 Drawing Sheets

(56) References Cited

U.S. PATENT DOCUMENTS

| | | | | |
|---|---|---|---|---|
| 6,685,480 | B2 | 2/2004 | Nishimoto et al. | |
| 7,059,963 | B2 * | 6/2006 | Okamura | A63F 13/10 463/3 |
| 7,951,045 | B1 | 5/2011 | Brader | |
| 2005/0032581 | A1 * | 2/2005 | Wagner | A63B 24/0021 473/173 |
| 2005/0261073 | A1 | 11/2005 | Farrington, Jr. et al. | |
| 2008/0102991 | A1 | 5/2008 | Hawkins | |
| 2010/0302142 | A1 * | 12/2010 | French | A63B 24/0003 345/156 |
| 2011/0270135 | A1 * | 11/2011 | Dooley | A61B 5/7445 600/595 |
| 2012/0251990 | A1 | 10/2012 | Urbanowski et al. | |
| 2012/0316011 | A1 | 12/2012 | Milosevic | |
| 2013/0095924 | A1 * | 4/2013 | Geisner | G09B 19/0038 463/32 |
| 2014/0080108 | A1 * | 3/2014 | Zimmerman | G06F 19/3481 434/247 |

FOREIGN PATENT DOCUMENTS

| | | | |
|---|---|---|---|
| CN | 101947384 | B | 2/2012 |
| CN | 202751767 | U | 2/2013 |
| DE | 10306918 | A1 | 9/2004 |

* cited by examiner

BADMINTON TRAINING AND CONDITIONING SYSTEM AND METHOD

CROSS REFERENCE TO RELATED APPLICATIONS

This non-provisional application is based on and claims priority from U.S. Provisional Application No. 62/015,670, filed Jun. 23, 2014, the disclosure which is hereby incorporated herein by reference in its entirety.

FIELD OF THE INVENTION

The present invention relates generally to an athletic training system and method, and more particularly to a badminton training system and method implemented as a computer program executed on a portable computing device for skill development and conditioning of badminton players.

BACKGROUND OF THE INVENTION

It is common for athletes in most sports to train and condition by practicing various skills through repetition. For illustrative purposes only, and without limiting the applicability of the invention to other sports, reference will be made to badminton in explaining the invention and its advantages. This invention, however, can be applied and can be of benefit to any athlete who participates in any other sport.

In the sport of badminton, for example, it is common for players to train by repeatedly running to and from the corners of a badminton court. Typically, when a badminton player trains with a coach, the training routine is done under manual guidance and control of the coach. For instance, a coach may decide that footwork and conditioning training is needed for a player moving sequentially from one of the front corners of the badminton court to one of the back corners of the court, or from one of the back corners to one of the front corners of the badminton court. Subsequently, a coach may decide that a player needs to randomly chase badminton shuttlecocks (birds) to four corners of a badminton court. These traditional training methods usually rely on a coach or trainer devising a sequence of drills for the player to perform. Most often, the coach or trainer will accompany a player to a badminton court to direct the player through the sequence of drills by standing in the center of the court and quickly pointing a hand or finger to a specified corner location of the court that a player should move. This is disadvantageous, however, since coaches and trainers are not only a very expensive part of the badminton training program, but they usually must work with players on a one-on-one basis. Moreover, the training process further requires a coach or trainer to reserve a badminton court to conduct the sequence of drills and court time is very limited, as well as very expensive.

Various types of training systems have been developed to automate and control the training of player movements on a badminton court. It is known that some of these training systems include training programs implemented on computers. Examples of such training systems are described in Chinese Publication CN201862234 U, entitled "Auxiliary Device for Badminton Pace Training;" Chinese Publication CN101947384 B, entitled "Auxiliary Means Pace Training Badminton;" and German Publication DE10306918 A1, to Lorenz et al., entitled "Movement Training Apparatus for Racket Sports such as Badminton, has control unit connected to Transmitters and Receivers in Game Area, with Signaling Devices arranged in Net." The disclosures in all of these documents are incorporated herein by reference in their entirety. These prior art training systems, however, suffer from many drawbacks that have limited their use by coaches and trainers. For example, these training systems are often difficult to use and calibrate since each requires auxiliary courtside equipment (such as lasers and photodetectors or transmitters and receivers) to be coupled to a control device which is used by the system to activate a position indicating means (e.g., a backlight azimuth arrow or an optical/acoustic signal generator) to designate an area of the badminton court a player is to move.

While these prior art training systems provide training regimens which may be an improvement over the training regimens done under manual guidance and control of a coach or trainer, a need exists for a simple, inexpensive, and easy-to-use training system that permits badminton players to improve their footwork and conditioning without the need for a coach or trainer to be present to conduct the footwork and conditioning drills, and which further permits elimination of the auxiliary courtside equipment required by the aforementioned prior art training systems. Additionally, a need exists for a training system that will not only permit images of the footwork and conditioning drills to be projected and/or displayed on a display device in a manner such that players on several badminton courts can be trained at one time, but will permit players to practice footwork and conditioning on their own in any location with a suitable playing surface.

SUMMARY OF THE INVENTION

Accordingly, it is an object of the present invention to provide an athletic training system and method implemented as a computer program executed on a portable computing device to help badminton players improve footwork and conditioning. Aspects of the present invention are appropriate for use while a player moves on a real badminton court or is in any location with a suitable playing surface.

It is another object of the present invention to provide an athletic training system and method that assists badminton players to improve their footwork and conditioning by displaying on a drawing, display, or image of a badminton court an arrow designating a specific area of the court a player is to move.

It is a further object of the present invention to provide a training system that automates many of the manually implemented tasks now being performed by coaches and trainers, and which system is portable and provides multiple footwork and conditioning exercises.

Still another object of the present invention is to provide a computer program executed on a computer device having training modules which include one or more training sessions per module and one or more training sets per session.

Yet another object of the present invention is to provide a training system and method implemented as a computer program executed on a computer device which reads stored training modules (with a collection of sessions, sets, work, and rest periods) from an external Extensible Markup Language (xml) file and displays arrows according to the information for the sessions and sets in the file.

In one example embodiment of the present invention, a method is provided which comprises reading stored training modules (with a collection of sessions, sets, work, and rest periods) from an external xml file and displaying arrows on a display according to the information for the sessions and sets in the file to improve footwork and conditioning of a badminton player.

In another example embodiment of the present invention, one or more computer readable storage media encoded with software comprising computer readable instructions are provided. The one or more computer readable storage media are encoded with instructions that, when executed, are operable to read stored training modules (with a collection of sessions, sets, work, and rest periods) from an external xml file and display arrows on a display according to the information for the sessions and sets in the file to improve footwork and conditioning of a badminton player.

Other aspects and advantages of the disclosure will be apparent to those skilled in the art on reviewing the drawings referenced below and reading the following detailed description. While these descriptions go into specific embodiments of the invention, it should be understood that variations may and do exist and will be apparent to those skilled in the art based on the description herein.

BRIEF DESCRIPTION OF THE DRAWINGS

The above mentioned and other features of the present invention, and the manner of attaining them, will become more apparent and the invention itself will be better understood by reference to the following description of specific embodiments of the invention taken in conjunction with the accompanying drawings, wherein like reference numerals in the various figures are utilized to designate like components and elements, and in which.

DETAILED DESCRIPTION OF THE INVENTION

Embodiments of the present invention are generally directed to a computer software system which helps badminton players improve footwork and conditioning. The system performs this function by displaying a direction indicator arrow to one of six areas on an image of a badminton court. The player moves on a real court in the direction indicated by the arrow displayed on the system's image of a badminton court. The system has the ability to display these arrows in several ways: (1) randomly to all six areas, (2) randomly to any subset of the six areas, (3) sequentially to all six areas, (4) sequentially to any subset of the six areas, and (5) by the speed with which the arrows are displayed.

The system of the present invention uses a training structure organized from highest to lowest level as follows: a training module; one or more training sessions per module; and one or more training sets per session. That is, module→session→set. When a player trains using this system, the player follows a predetermined sequence of sessions and sets contained within a training module. The sequence of sessions could include a warm up session, several main sessions, and a cool down session. Each of these sessions could include one or more sets.

Figure 2:
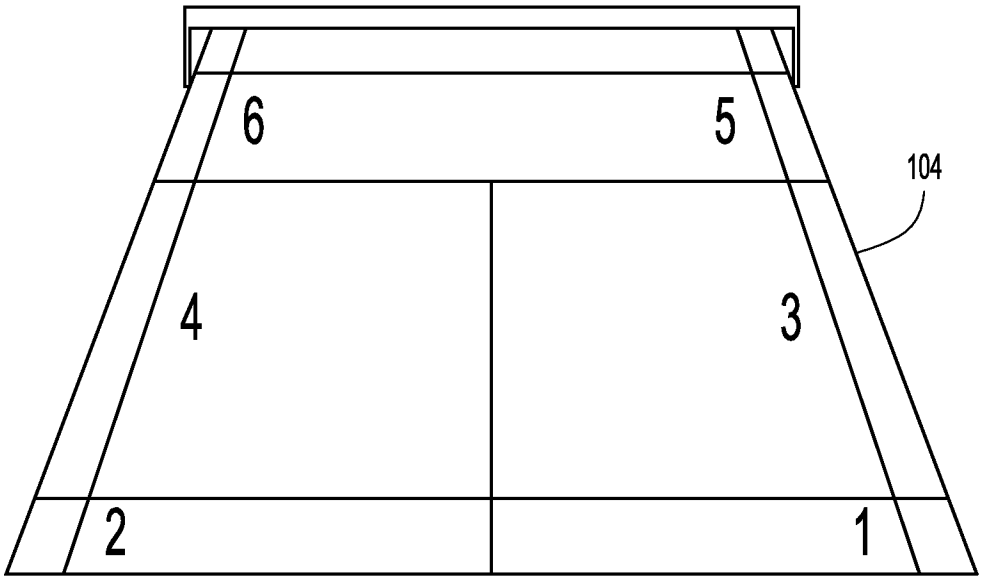
FIG. 2 is a schematic diagram of a typical six corner badminton court illustrating the numbering of the corners.

A coach, for instance, may decide that footwork training or conditioning is needed for a player moving from the right-front corner (corner 5) to the back-left corner (corner 2) then, randomly, to either the left-front corner (corner 6) or the right-front corner (corner 5) of a typical six corner badminton court. (FIG. 2 illustrates exemplary corner numbering for a typical six corner badminton court.) After the player completes the above sequence of movements, the coach may decide that the movements should be repeated randomly (so the player can't anticipate the movement) and should continue for 20 seconds (work set). The coach could give the player a 10 second rest before the next 20 second work set begins. The coach may also decide that this sequence of 20 seconds of work and 10 seconds of rest should be repeated 15 times. Thus, this training module would have one session with 15 sets and, in total, would last (20+10)×15=7.5 minutes.

The system of the present invention can accommodate and mimic this kind of interval training since the system reads stored training modules (with its collection of sessions, sets, work and rest periods) from an external xml file. The system then displays arrows on a display according to the information for the sessions and sets of a training module in the file.

Figure 1:
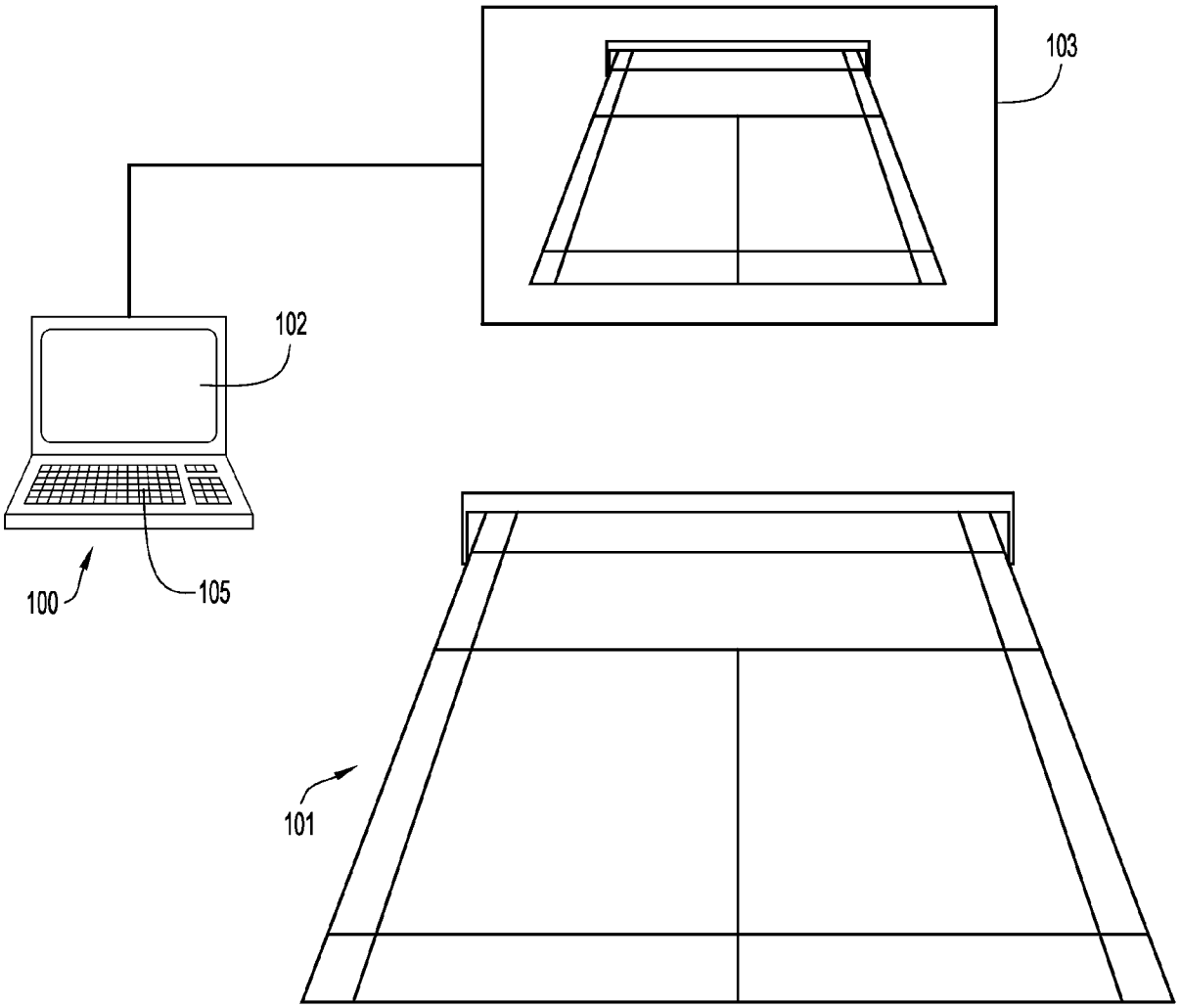
FIG. 1 is a perspective view of the components of the badminton training and conditioning system in accordance with aspects of the present invention.

Referring to the accompanying drawings, FIG. 1 illustrates an embodiment of the present invention comprising an exemplary portable computing device 100 in the vicinity of a badminton court or other suitable surface 101 for executing the computer program for improving footwork and conditioning of badminton players and outputting images and/or video resulting from the program directly to a display 102 of the computing device 100 or to a separate display 103 in communication with the computing device 100, such as a large screen LED or LCD TV display or any other suitable display device. The separate display device 103 may be in wired communication with the computing device 100 or may communicate with the computing device wirelessly. Moreover, the computing device 100 may be a laptop computer, tablet computer, mobile phone, personal digital assistant (PDA), or the like. For example, a suitable commercially available portable computing device for use with the method and system of the present invention is a MacBook® laptop computer. MacBook is a registered trademark of Apple Inc., 1 Infinite Loop Cupertino, Calif. 95014.

Figure 3:
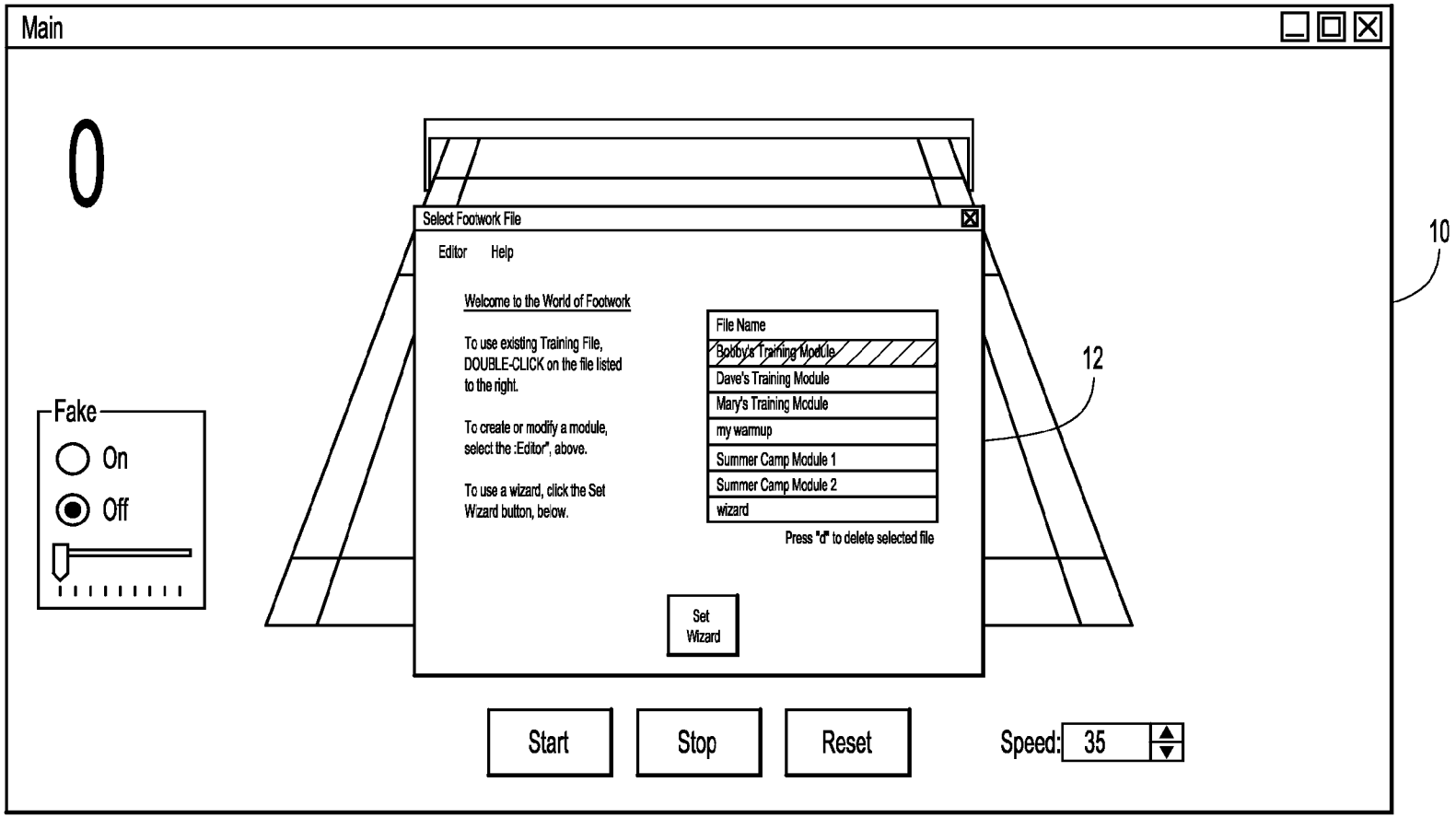
FIG. 3 is a schematic diagram of the system's main screen with an overlying training module selection screen.

When the system of the present invention is started, a splash page (i.e., an introduction page having animations, graphics, and sound) is displayed. Upon closing of the splash page, the system's main screen 10 appears (see FIG. 3). The main screen 10 includes a training module selection screen 12 overlaying an image of a typical badminton court 104.

Figure 4:
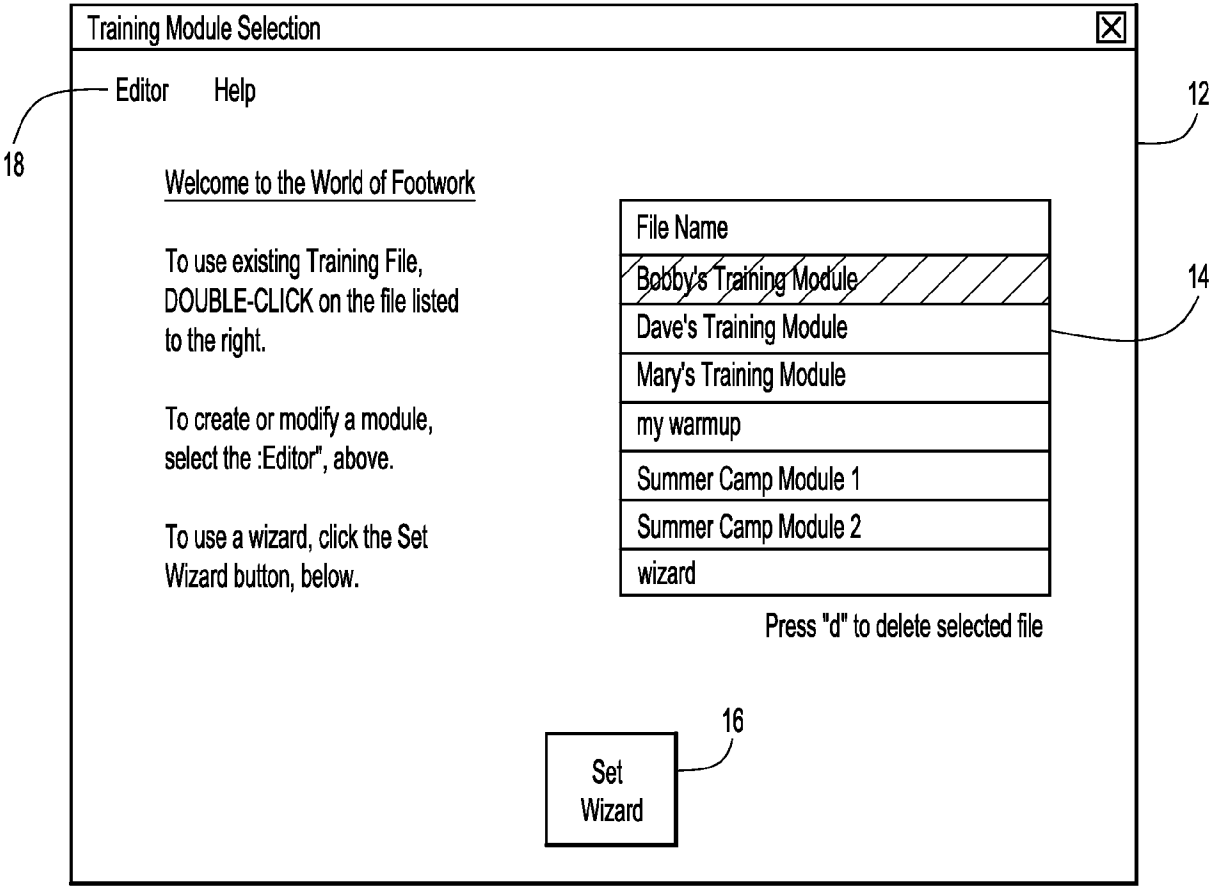
FIG. 4 is a schematic diagram of an enlarged view of the training module selection screen of FIG. 3.

As more clearly shown in FIG. 4, the training module selection screen 12 includes a list of available training modules 14. For instance, the list may include training modules designed for specific athletes (e.g., Bobby's Training Module), a warmup module (e.g., my warmup), or other previously saved training modules (e.g., Summer Camp Module 1). To select a module, a user simply double clicks the desired module from the displayed list of modules and data stored in the module's xml file is loaded into the system. In addition to the list of modules 14, the training module selection screen 12 includes a Set Wizard button 16 which opens the system's wizard and an editor link 18. The system wizard provides a quick and easy way to create a new training set. At this point, a training module from the list of modules 14 can be deleted by highlighting the module to be deleted (e.g., Bobby's Training Module) and pressing the "D" key (lowercase for delete) on the computer keyboard 105 (FIG. 1).

Figure 5:
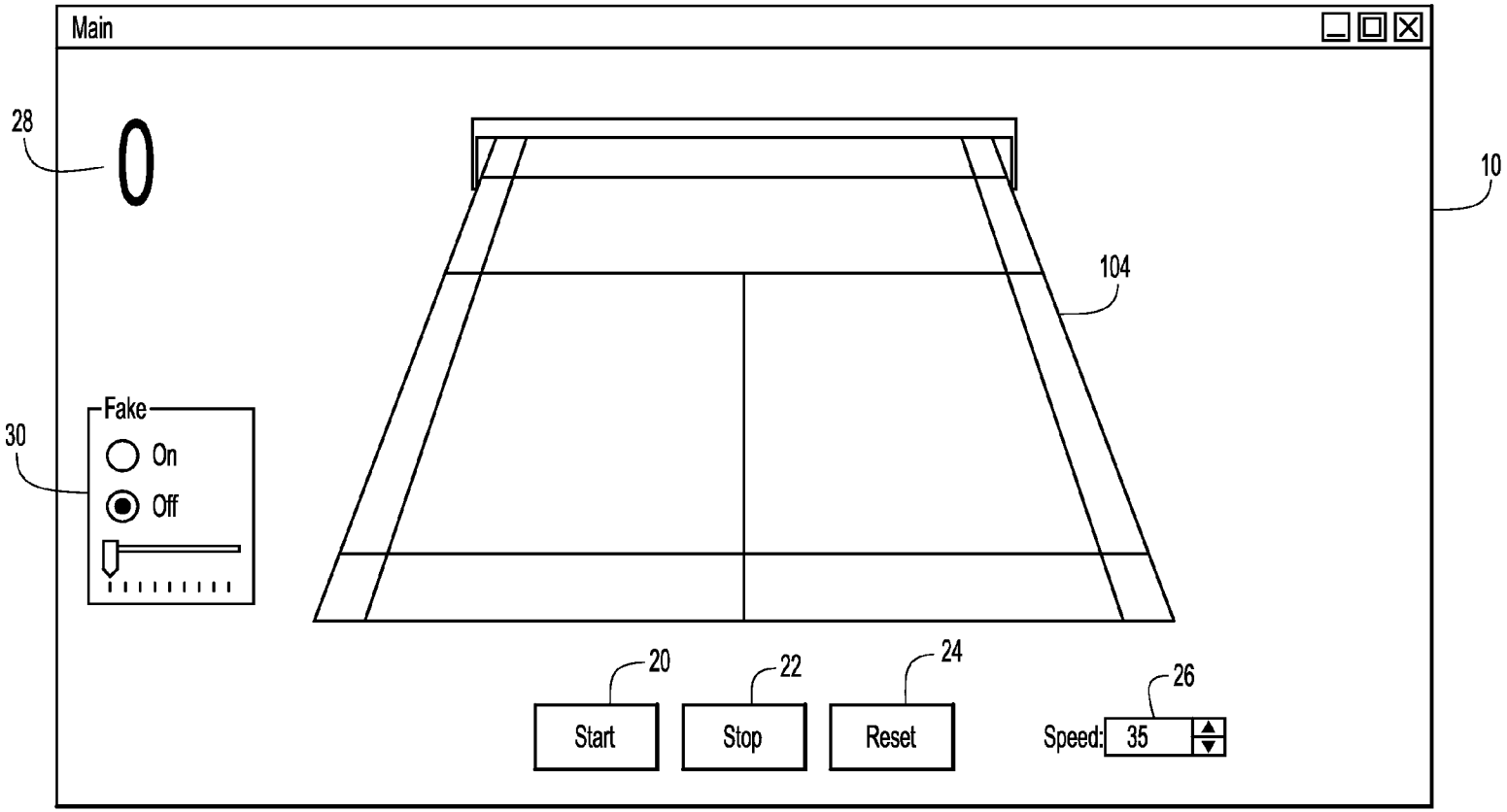
FIG. 5 is a schematic diagram of the main screen prior to running of a training module from the training module selection screen of FIG. 4.

As illustrated in FIG. 5, the main screen 10 further includes a start button 20, a stop button 22, a reset button 24, a speed selector 26, a counter 28, and a fake controller 30 comprising radio buttons and a slider. The start button 20 allows a user to begin or resume the execution of a training module, the stop button 22 permits a user to stop the system from executing a training module, while the reset button 24 enables a user to pull up the training module selection screen 12 (see FIGS. 3 and 4). The counter 28 operates in two modes. Depending on the configuration of a session chosen by a user, the counter either counts down by seconds or counts up by repetitions. For instance, the counter 28 counts down by seconds if the user selects timed training and it counts up by repetitions if the user selects count training.

Figure 7:
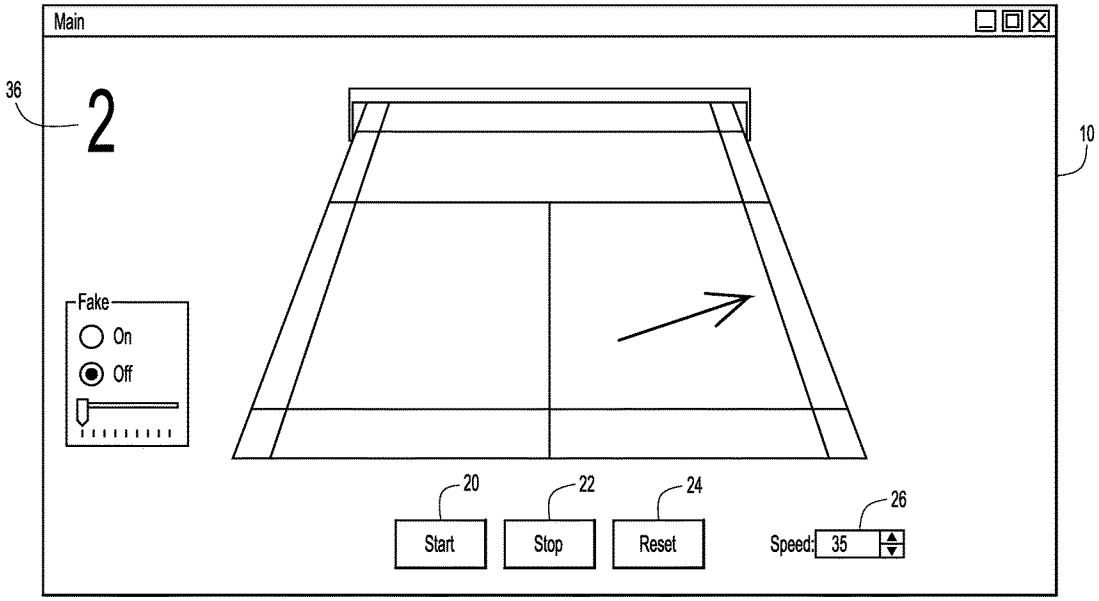
FIG. 7 is a schematic diagram of the main screen of FIG. 5 with an arrow indicating the direction a player is to move when a training module is being run by the system.
Figure 8:
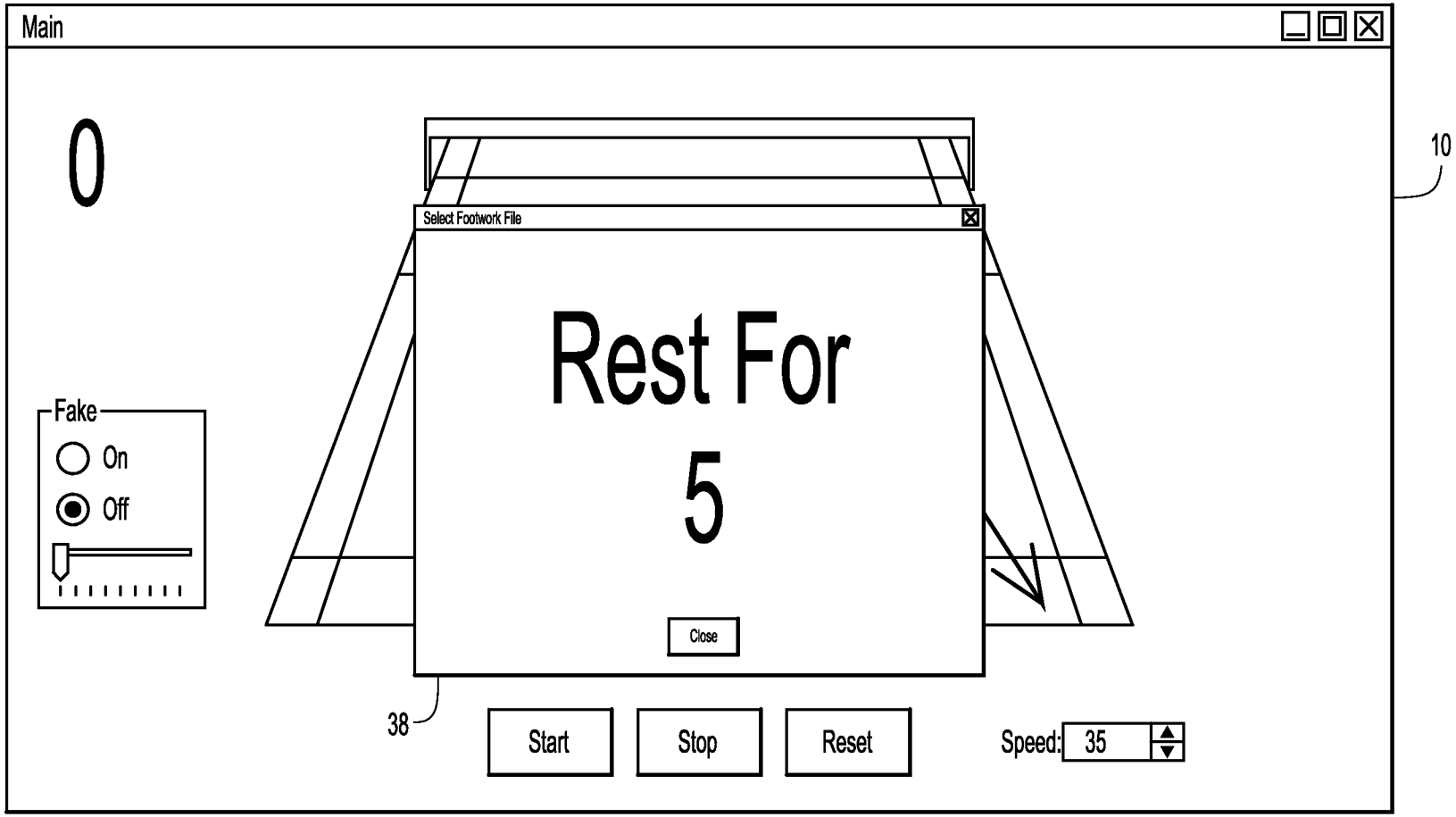
FIG. 8 is a schematic diagram of the main screen of FIG. 5 with an overlying countdown screen indicating a timed rest period between sets for a training session being run by the system.
Figure 9:
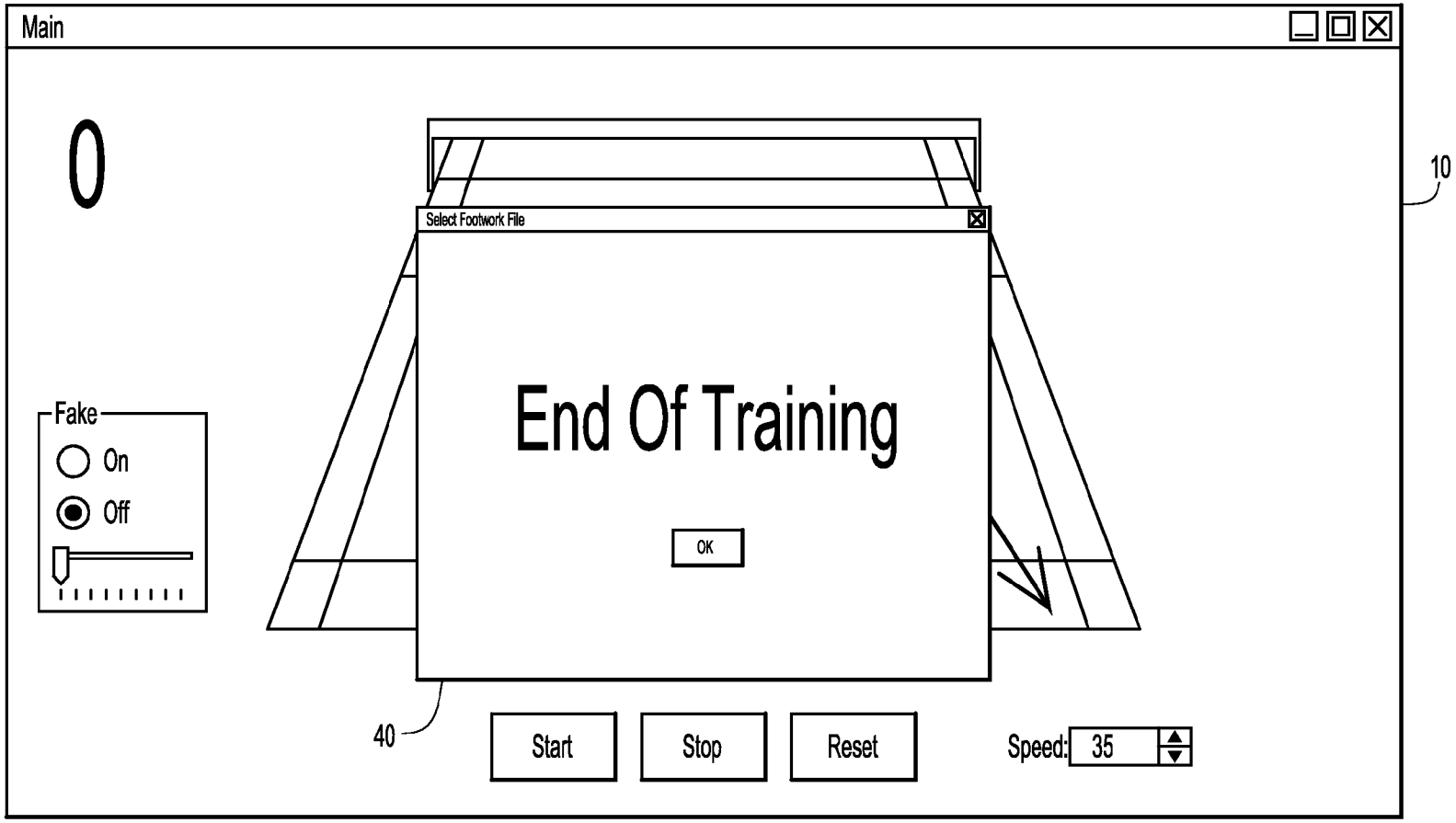
FIG. 9 is a schematic diagram of the main screen of FIG. 5 with an overlying screen indicating to a user (player) that the last set in the last session of a training module has been completed.
Figure 10:
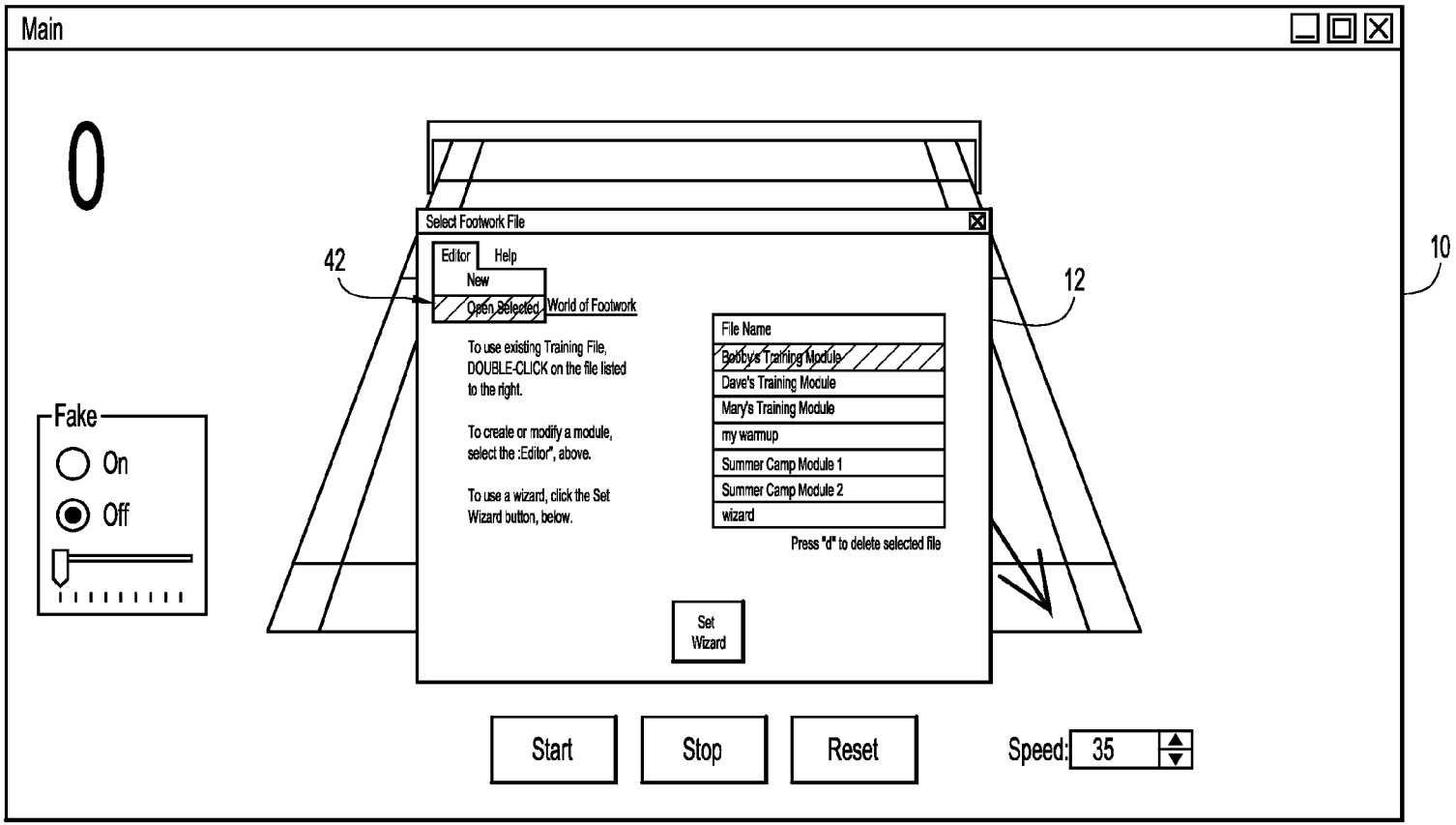
FIG. 10 is a schematic diagram of the training module selection screen overlying the system's main screen of FIG. 3 with an editor submenu of the training module selection screen displayed.

As used in the present application, the term "fake" relates to a deceptive move by a badminton player where the player appears to swing and hit a bird in one direction but the bird actually moves in another. This deceptive move is done by subtle changes in the racket face that is very hard to observe by novice players as well as players with high skill levels. Accordingly, the radio buttons and slider of the fake controller 30 permit a user to turn a fake feature on and off and control the fake speed so that a player may practice recovering quickly from a fake and get to the bird. Specifically, when the fake feature is turned on, the system of the present invention will display a direction indicator arrow 34 (representing a fake) to one corner of the badminton court (see FIG. 7), and then quickly point the arrow in another random direction, e.g., the back-right corner of the badminton court, as shown in FIGS. 7-9. The purpose of this feature is to help players learn to change direction quickly while maintaining stability and controlling their center of gravity. The speed selector 26 is used to control how quickly the system changes the direction indicator arrow 34—representing a fake—to the various corners of the badminton court.

Figure 6:
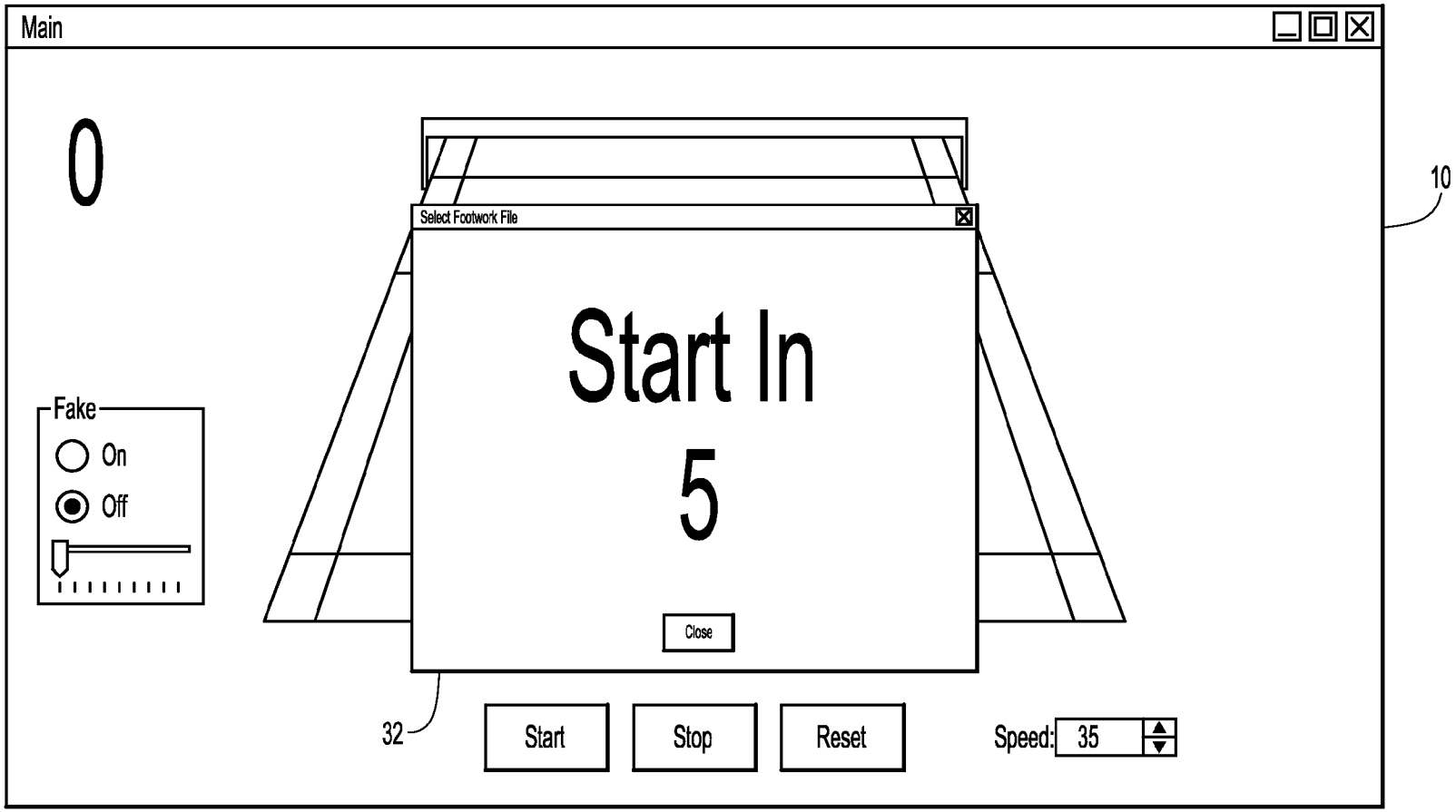
FIG. 6 is a schematic diagram of the main screen of FIG. 5 with an overlying countdown screen indicating the time remaining until the beginning of a training module's training session.

FIG. 6 illustrates a countdown menu 32 which flashes onto the main screen prior to the beginning of the training module's training session. When the countdown screen reaches zero (0) seconds remaining, the countdown screen disappears and the system begins to run a training module, e.g., selected from the list of available training modules shown in FIGS. 3-4. In the session depicted in FIG. 7, the system superimposes a direction indictor arrow 34 (representing a fake) on the image of the badminton court displayed on the main screen 10. The arrow 34 indicates the direction in which a player practicing footwork and conditioning drills is to move (FIGS. 7-10). The arrow may be either red or blue depending on the type of shuttlecock or bird to be played. For instance, a red arrow indicates that the player is to play a bird high, while a blue arrow indicates that the player is to play a bird low. In addition, the system displays the time remaining in the work portion of the current set as well as the speed setting for the direction indicator arrow 34. In the session shown in FIG. 7, two seconds (indicated by numeral 36) remain until the end of the current set and the speed setting for displaying arrow 34 is set to the numerical value 35. Moreover, a user may pause the current training session by pressing the stop button 22, resume the current training session by pressing the start button 20, and select another training module by pressing the reset button 24. However, while the system is running the training module, both the start and reset buttons are disabled (i.e., grayed out).

FIG. 8 depicts a rest period countdown screen 38 superimposed on the main screen 10, and FIG. 9 illustrates an end of training session screen 40 superimposed on the main screen. The countdown screen appears on the main screen between sets of the training module's training session, while the end of training session screen appears only at the completion of the last set in the last session of the training module. The rest period between sets of the session in FIG. 7 is shown to be 5 seconds. At the conclusion of the rest period (i.e., when countdown screen reaches 0 seconds), the countdown screen 38 disappears and the system begins running the next set in the session of the training module. As previously mentioned, it is only when the user (player) has completed the last set in the last session of the training module that the end of training session screen is displayed.

Figure 11:
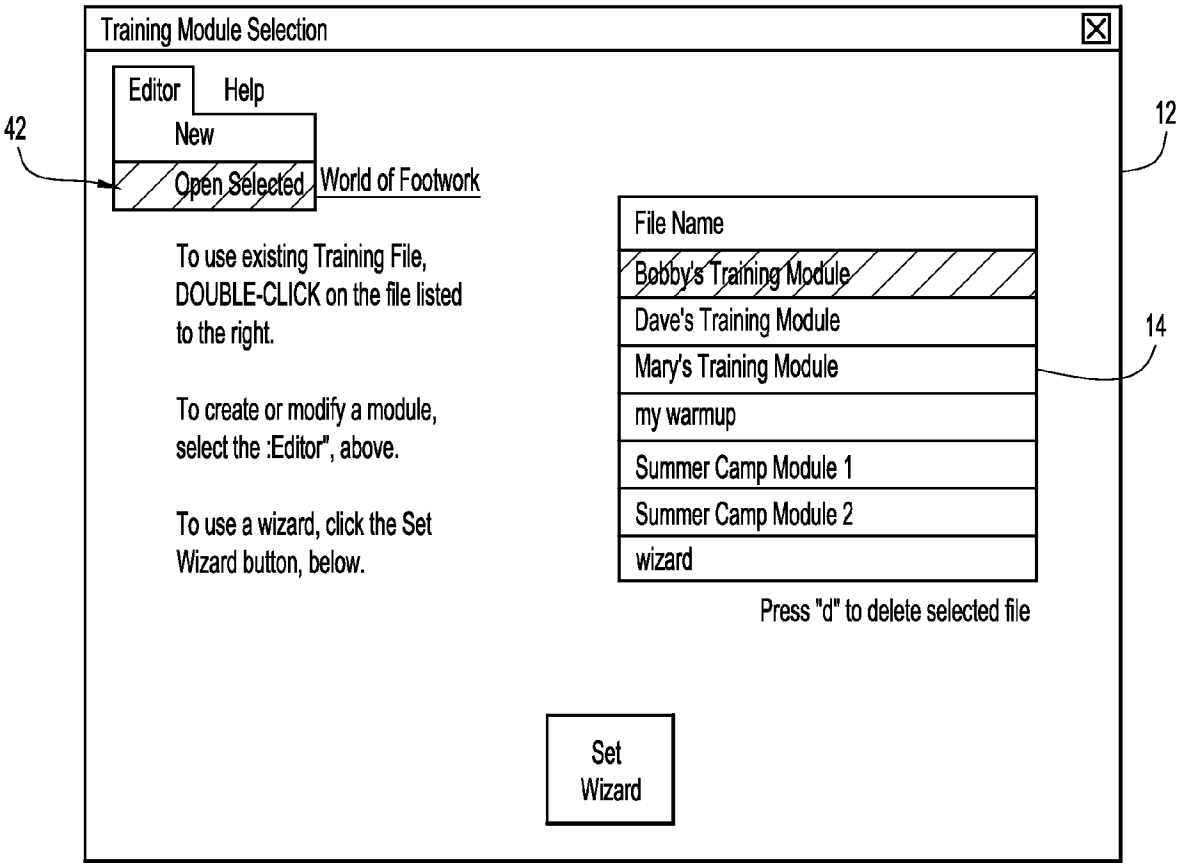
FIG. 11 is a schematic diagram of an enlarged view of the training module selection screen with the editor submenu of FIG. 10 displayed.

The various training modules for improving footwork and conditioning of a player may have an unlimited number of sessions as well as an unlimited number of sets per session. Therefore, in order to modify a training module, as well as to create new training modules, the system of the present invention is provided with an Editor feature. The Editor feature may be opened from the training module selection screen 12 by selecting and clicking on an editor link (see FIGS. 10 and 11). Once clicked, a dropdown menu 42 appears. The dropdown menu includes a "new" link and an "open selected" link. To open a training module for editing, a user highlights a specific training module from the list of available modules 14 on the training module selection screen (see FIG. 11) and clicks on the "open selected" link. To create a new training module, a user clicks on the "new" link.

Figure 12:
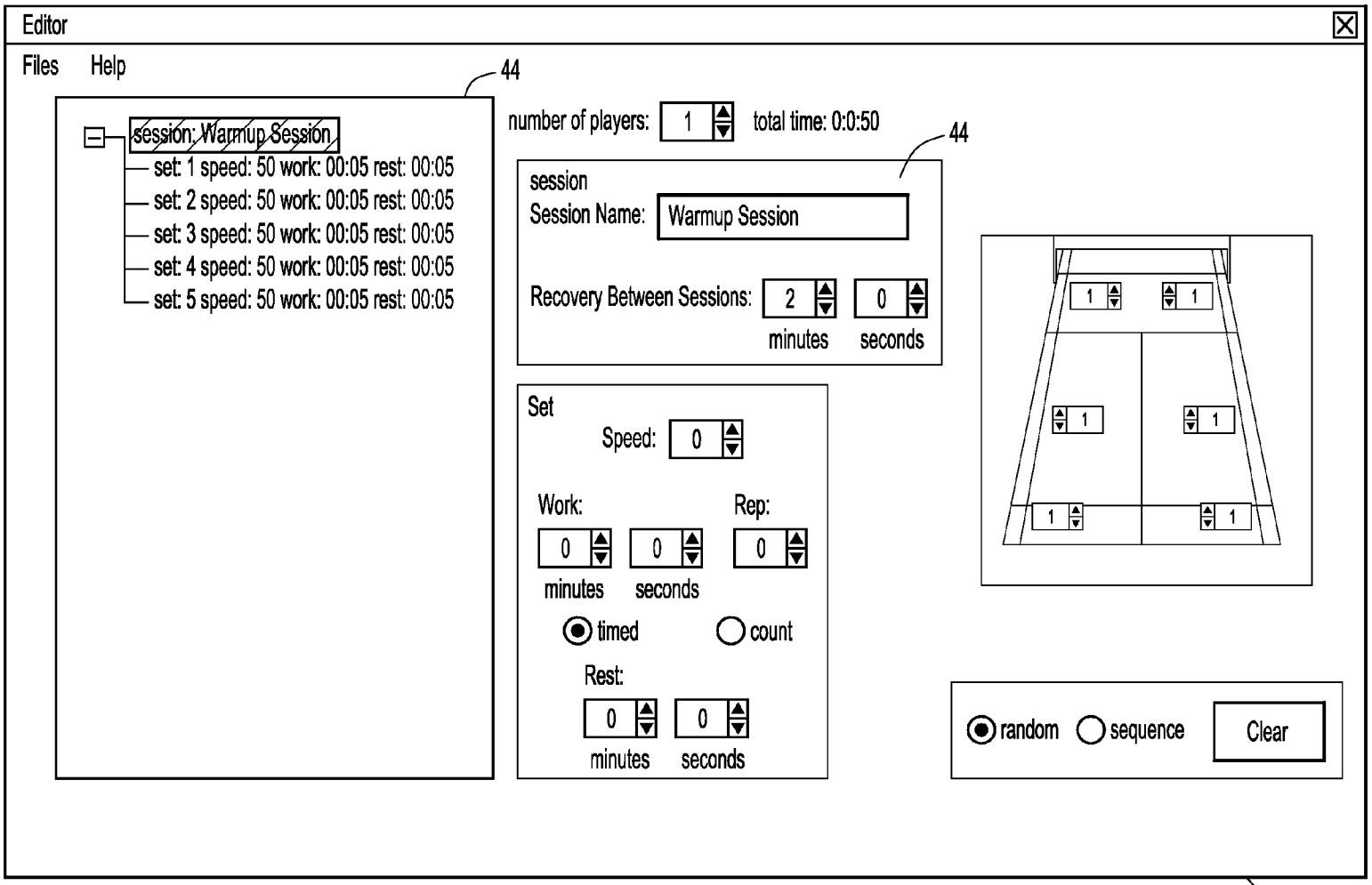
FIGS. 12-13 are schematic diagrams of editor screens of a training module illustrating different levels of information, with FIG. 12 showing information associated with a session of the training module and FIG. 13 showing information associated with the session's set.
Figure 13:
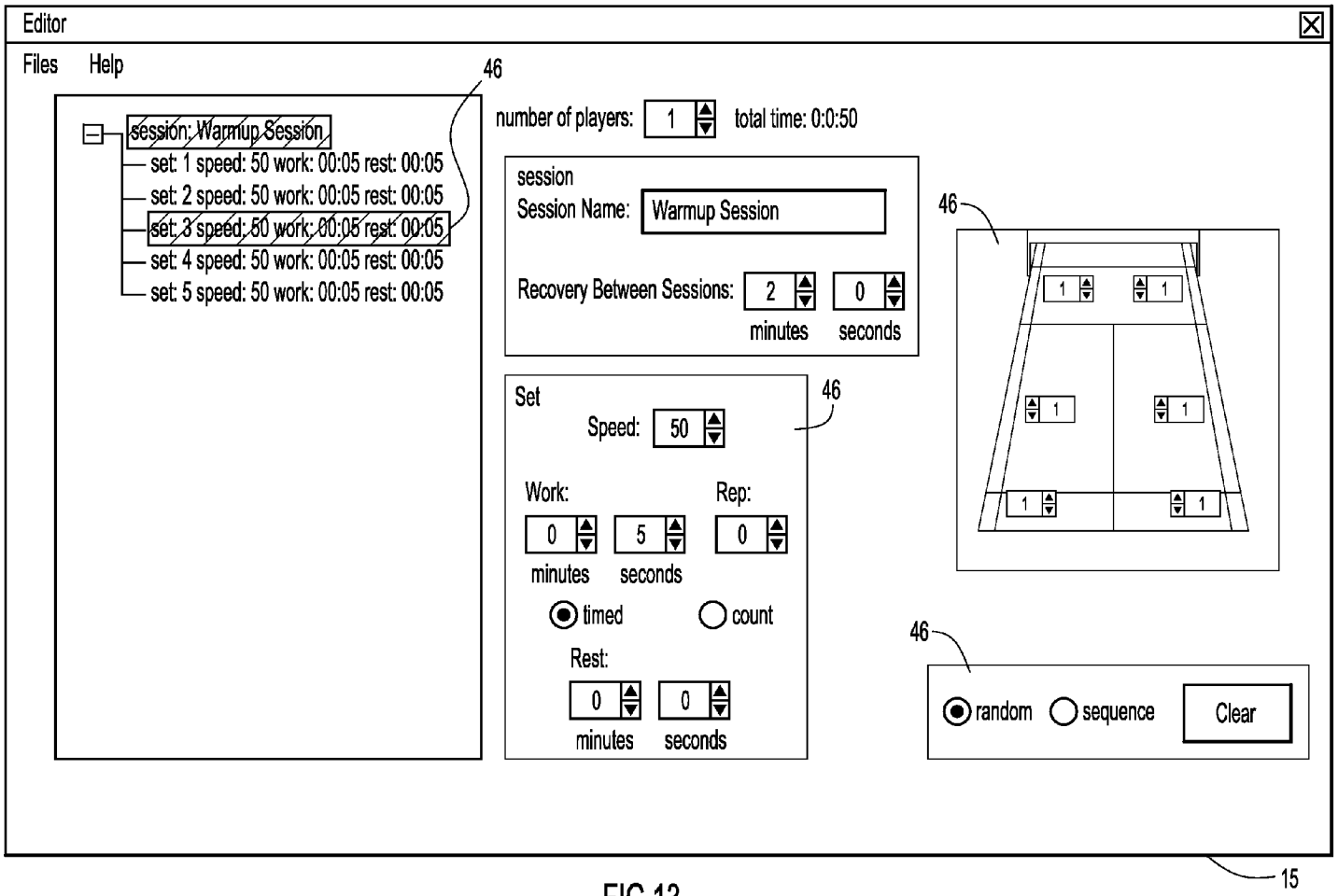

FIGS. 12-13 depict two views of the Editor 15. The difference between the two views is the "level" of information that is displayed. In this regard, FIG. 12 illustrates information associated with a session of a training module 44, e.g., the name of the session, while FIG. 13 shows further information associated with the session's set 46, e.g., time of set's work and rest portions.

Figure 14:
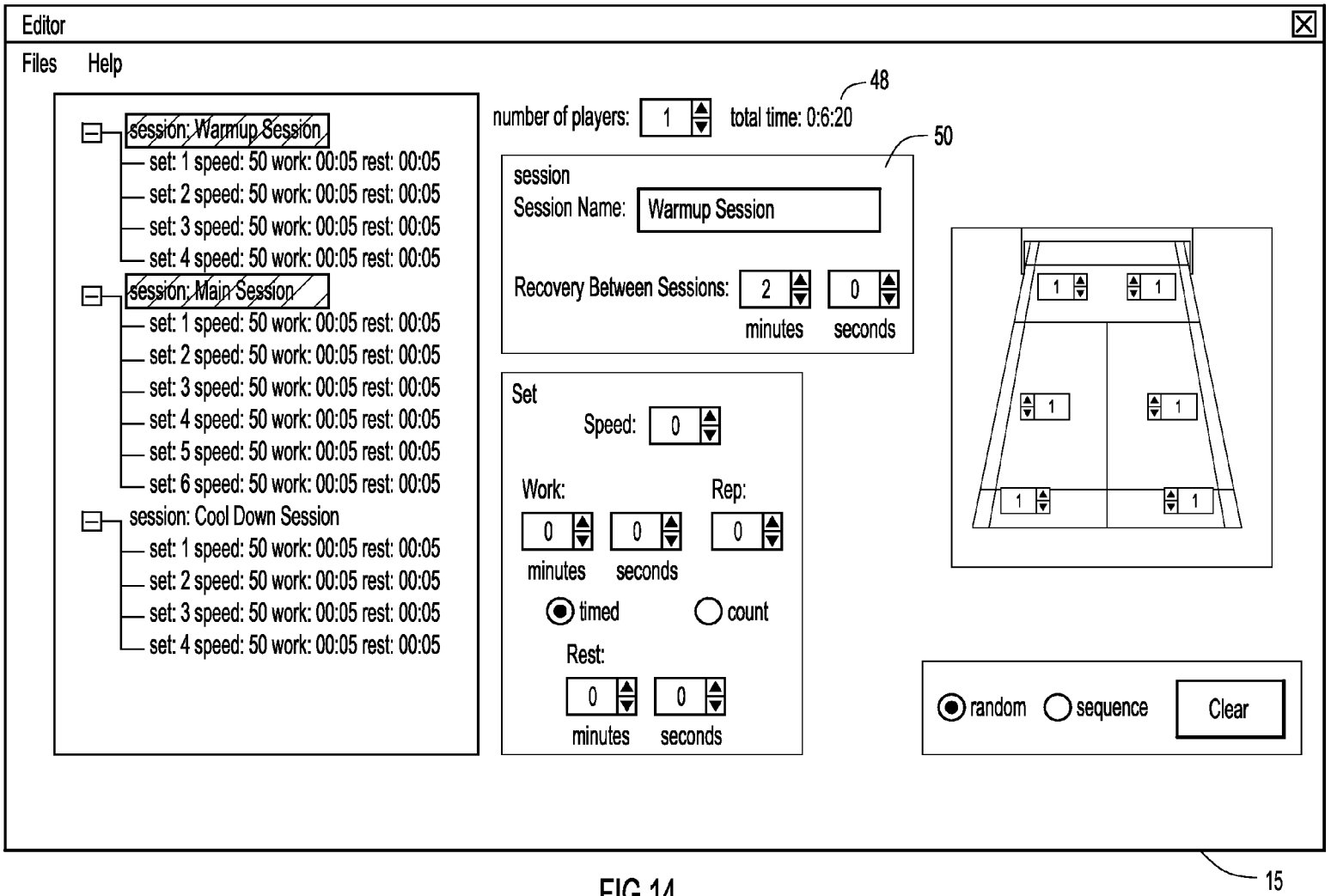
FIGS. 14-15 are schematic diagrams of the editor screens of FIGS. 12-13 illustrating various controls as they relate to training module sessions and sets.
Figure 15:
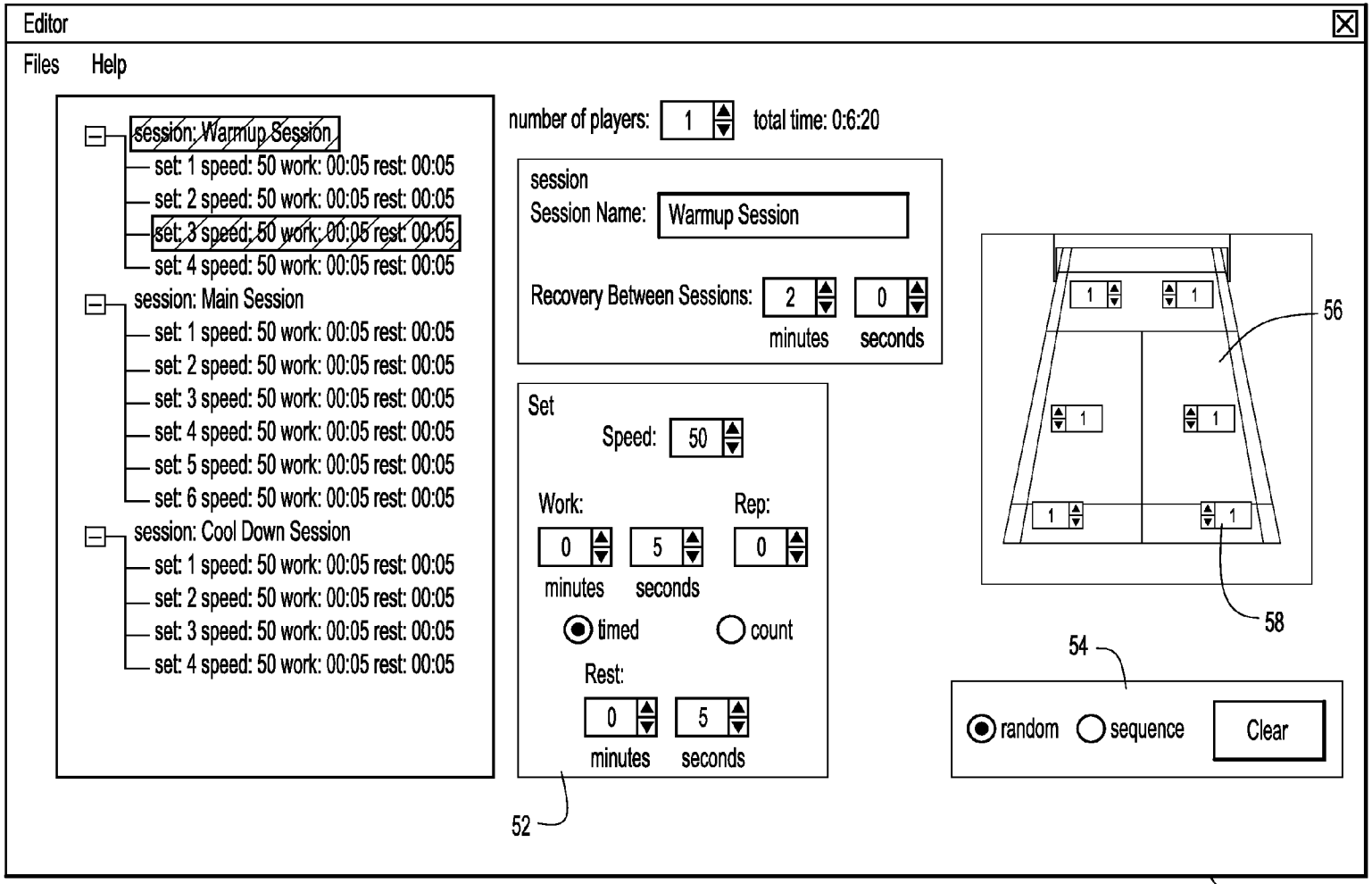

With reference to FIGS. 14 and 15, various controls are shown relating to the sessions and sets of selected training modules. Referring to FIG. 14, the Editor 15 keeps a running total for the amount of time required to run a module. As sessions and sets are added, modified or deleted, the system recalculates the total time to run the module as depicted by numeral 48. Also, there are times when a coach or trainer may wish to train several players or athletes one after the other. In this case, to calculate the total training time, for example, for four players, the coach would enter the number four (4) into the "number of players" window depicted in the figure. Once the number of players is entered, the system will quickly calculate the total time required to train four players. Numeral 50 represents a group of controls which allows the user to enter a name of the session and the amount of time a player can rest between sessions (minutes/seconds).

Referring to FIG. 15, the numeral 52 represents a group of controls which regulates (1) the speed that direction indicator arrow 34 flashes from corner to corner on the image of the badminton court, (2) whether the set is to be run as a timed training or a count training set, and (3) the amount of time a player may rest between sets. With respect to the control for regulating the speed the direction indicator arrow 34 flashes, the larger the number entered into the "speed" window, the faster or quicker the direction indicator arrow 34 will flash from corner to corner of the badminton court depicted in FIGS. 2 and 7, e.g., from corner 6 to corner 1 or from corner 5 to corner 2 (FIG. 2). Regarding the control for selecting whether the set will be run as timed or count training, if a user (player, coach or trainer) selects timed training, then the windows under the caption "Work" indicate the amount of time (usually seconds) the work portion of the set runs. If the user selects count training, then the window under the caption "Rep" indicates the number of repetitions for the work portion of training. As for the amount of time a player may rest between sets, the larger the number entered into the window beneath the caption "Rest" by the user of the system, the longer the period of rest between sets.

With further reference to FIG. 15, the numeral 54 represents a control for selecting whether the set will be run randomly or in sequence and numeral 56 represents a group of controls which allows the user to enter numerical values in the windows 58 at the six corners of the badminton court. If a user (player, coach or trainer) selects the "random" button, then the numerical values entered in each of the six corner windows 58 indicate the relative number of times direction indictor arrow 34 points to that corner. The numbers entered into the windows can be zero to any higher value. For example, the user could choose to enter the number 10 into the window at corner 5, the number 10 into the window at corner 6, and the number 5 into the window at corner 2. When running, the system will point arrow 34 randomly twice as often to corners 5 and 6 than it does to corner 2. Essentially, the system converts all the numerical values the user enters into the corner windows 58 to a percentage (%), and then points arrow 34 to corners 5 and 6 forty percent (40%) of the time and to corner 2 twenty percent (20%) of the time. The system continues to point the direction indicating arrow 34 to the corners of the badminton court the selected number of times entered into the each of the six windows 58 until the work portion of the training is stopped. On the other hand, if the user selects the "sequence" button, then the numerical value entered into each of the six corner windows 58 will indicate the order in which the system points arrow 34 to that particular corner. In this case, the numerical value entered into the window at each of the corners ranges from zero to six. Specifically, a user may enter any numerical value from zero (0) to six (6) into any corner window 58 and the system will continue to point arrow 34 in that sequence until the work portion of training is stopped.

Figure 16:
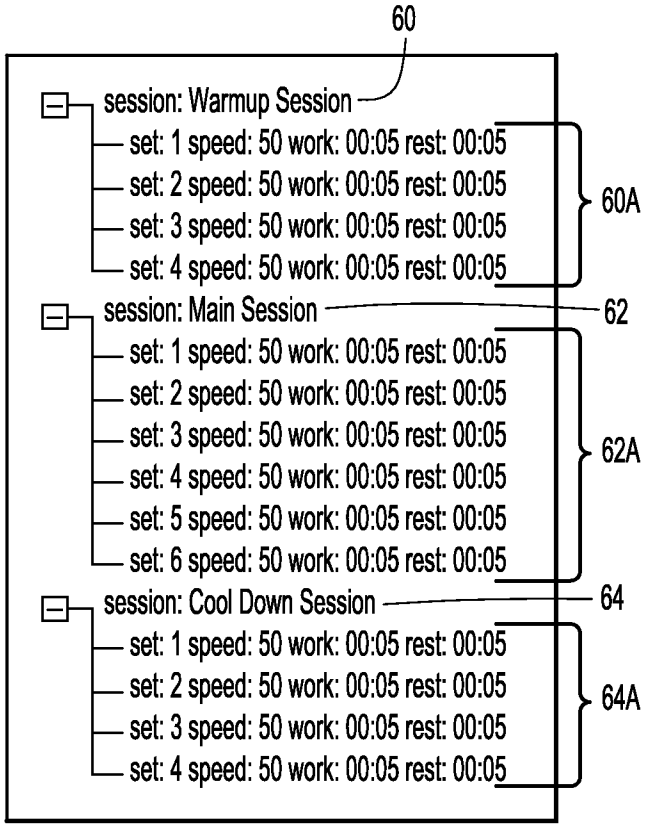
FIG. 16 is a schematic diagram of an enlarged view of the information displayed on the left portion of the editor screen of FIGS. 14-15.

FIG. 16 depicts an enlarged version of the left portion of the Editor 15 shown in FIGS. 14-15. As may be seen in this figure, the Editor displays a tree view of a training module. This training module includes three sessions, namely a warm up session 60 consisting of four sets identified by numeral 60A, a main session 62 comprising six sets identified by numeral 62A, and a cool down session 64 composed of four sets identified by numeral 64A. The speed, work and rest times shown in the tree view of the training module in FIG. 16 are merely exemplary. Any suitable combination of speed, work and rest times may be selected depending on the condition of the athlete or player being trained.

Figure 17:
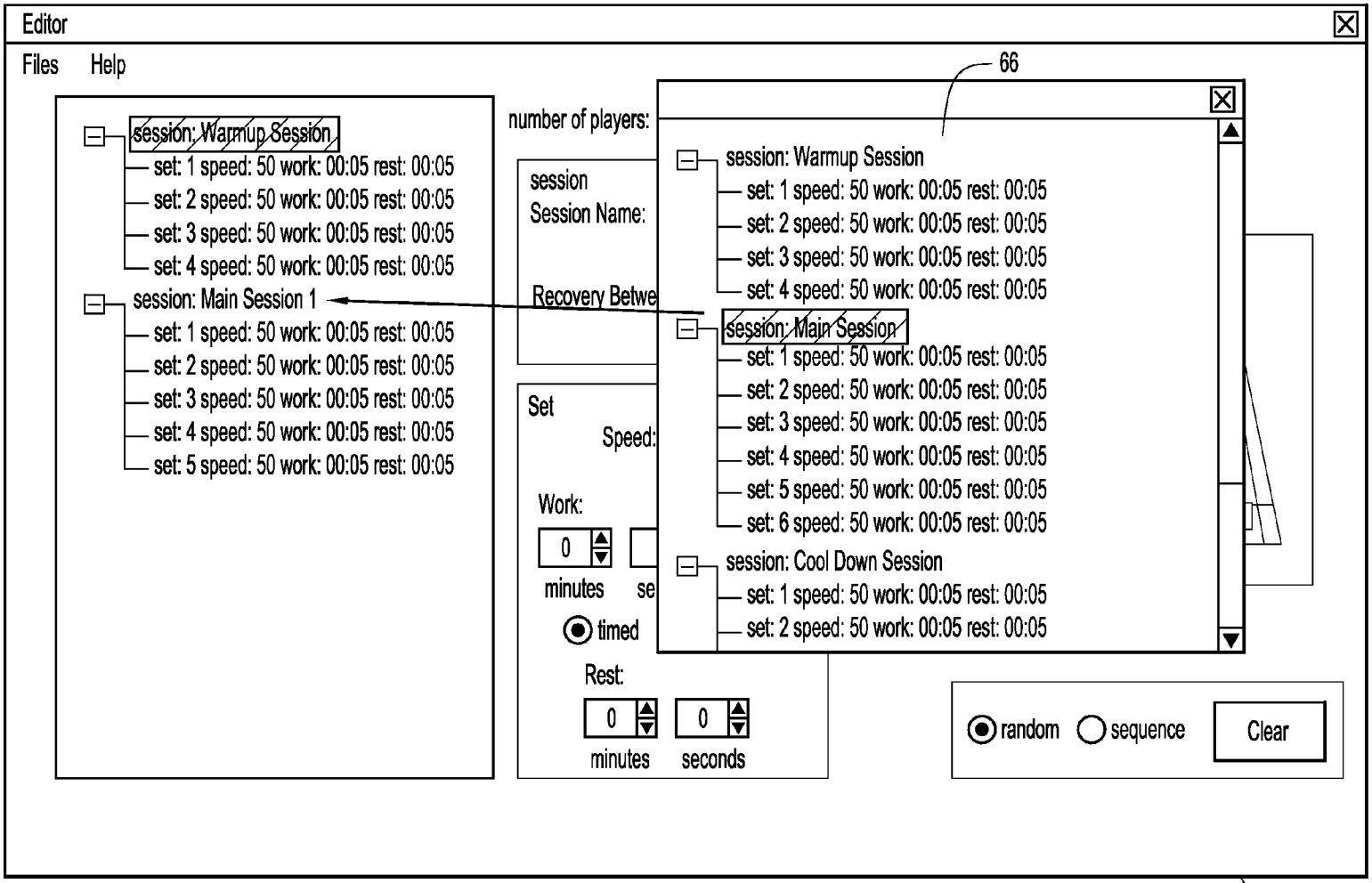
FIG. 17 is a schematic diagram of the editor screen of FIG. 14 with an overlaying "open drag" screen illustrating a highlighted record to be dragged over to the left portion of the screen and added to the training module.
Figure 18:
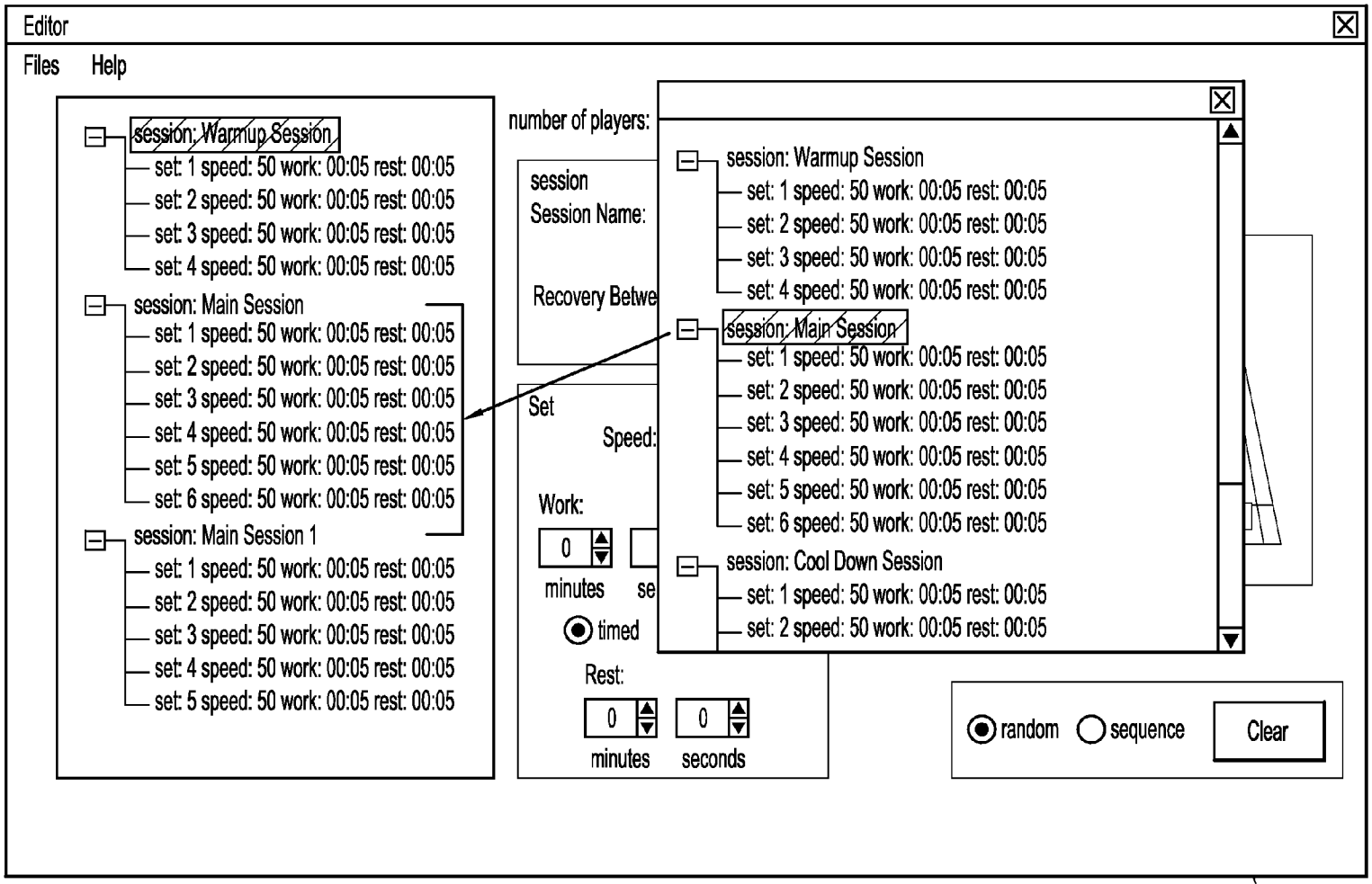
FIG. 18 is a schematic diagram of the editor screen of FIG. 14 with an overlaying "open drag" screen illustrating a highlighted record being dragged over to the left portion of the screen and added to the training module.

Referring to FIGS. 17 and 18, the Editor 15 is shown after the user (player, coach or trainer) selects "open drag from file" from a file menu (not shown). Once the "open drag from file" is opened (FIG. 17), the user can easily add an already existing session or set 66 to the tree view of the training module by simply highlighting the record and dragging (left mouse button down) the session or set into current training module displayed on the left side of the editor screen (FIG. 18). The specific training session shown being dragged into the current training module is merely exemplary. Any other training session/set may be selected and dragged into the tree view of the training module in a similar manner.

Figure 19:
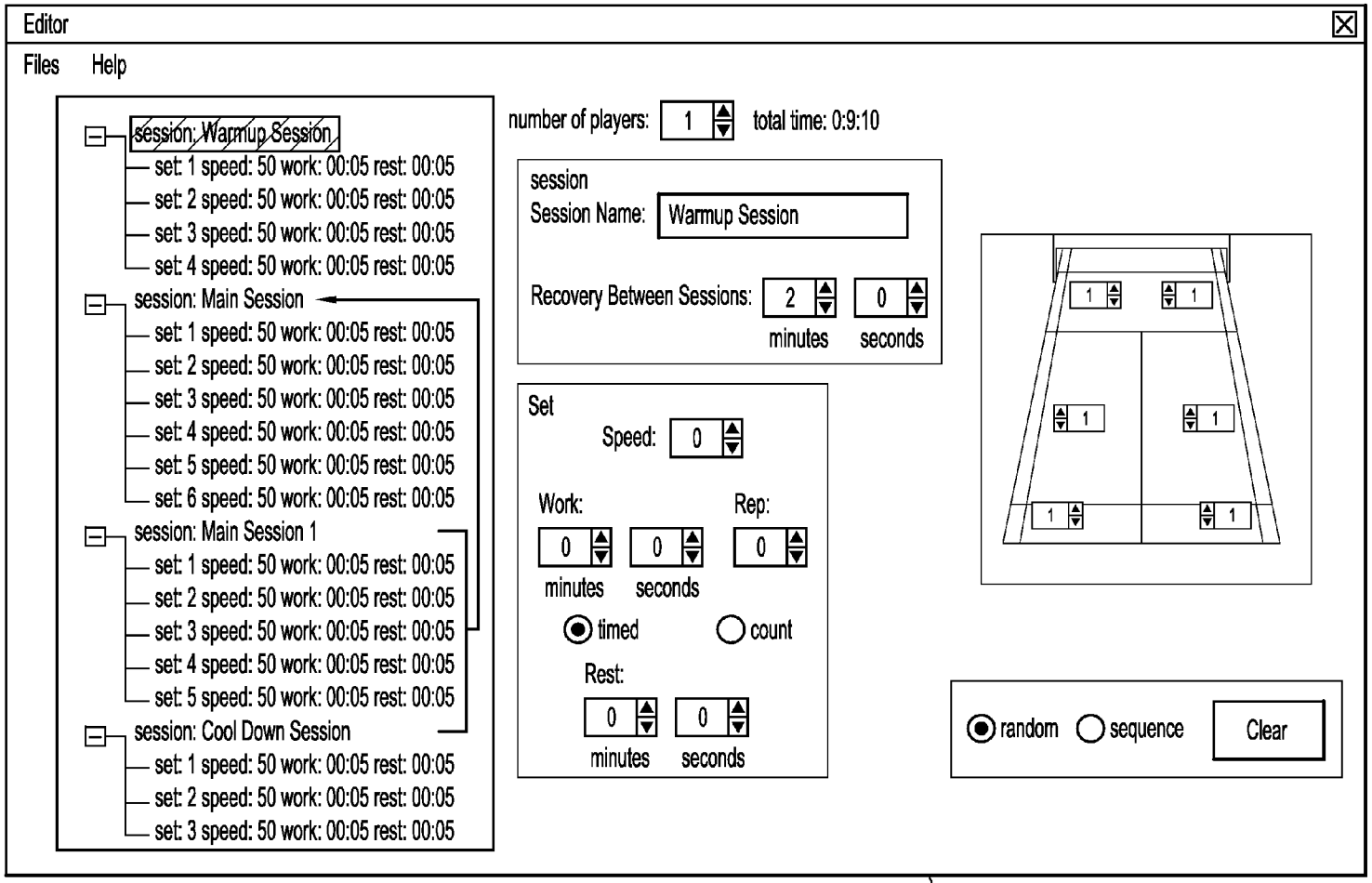
FIGS. 19-20 are schematic diagrams of the editor screen of FIG. 14 which illustrate moving training module sessions and sets within a training module.
Figure 20:
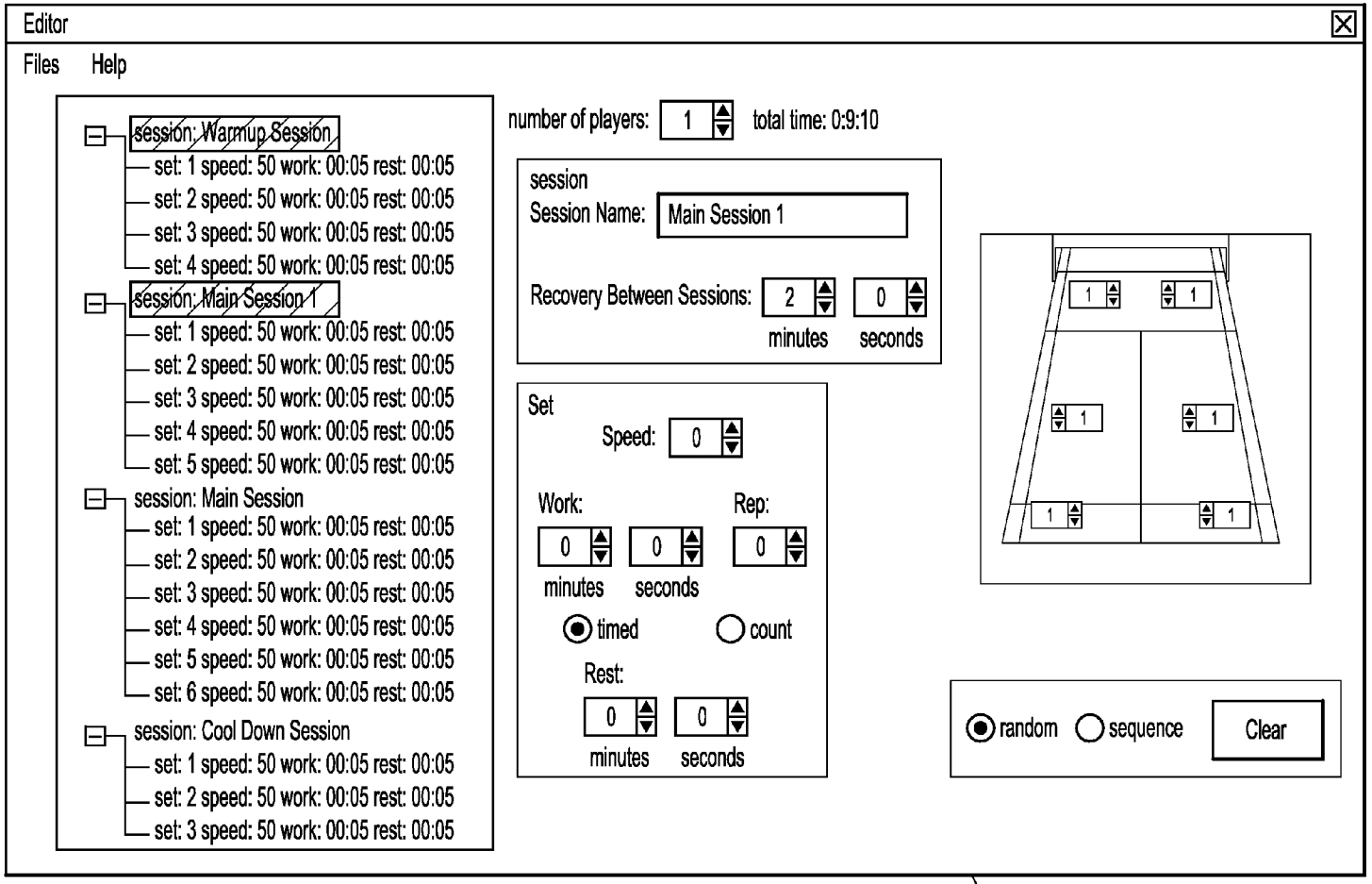

FIGS. 19-20 depict how a user (player, coach or trainer) can move both sessions and sets within a training module. A user needs to simply highlight the session or set to be moved and drag-and-drop it to the desired location within the training module displayed on the left portion of the editor screen. In FIGS. 19 and 20, Main Session 1 is shown being moved from below Main Session to above Main Session. The specific training session shown being moved within the current training module is merely exemplary. Any other training session may be selected and moved within the tree view of the training module in a similar manner.

Figure 21:
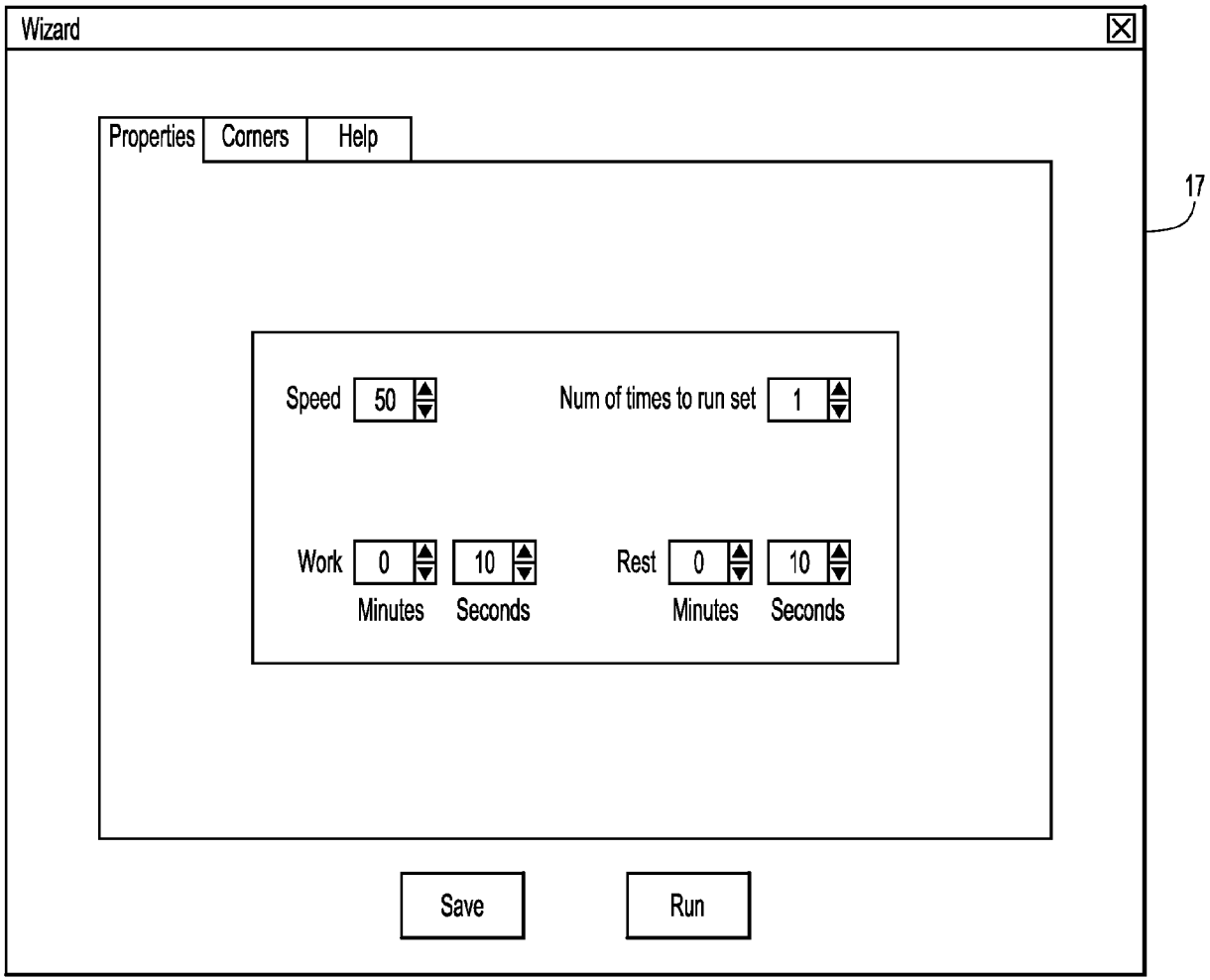
FIG. 21 is a schematic diagram of the set wizard screen with the properties tab selected by a user.
Figure 22:
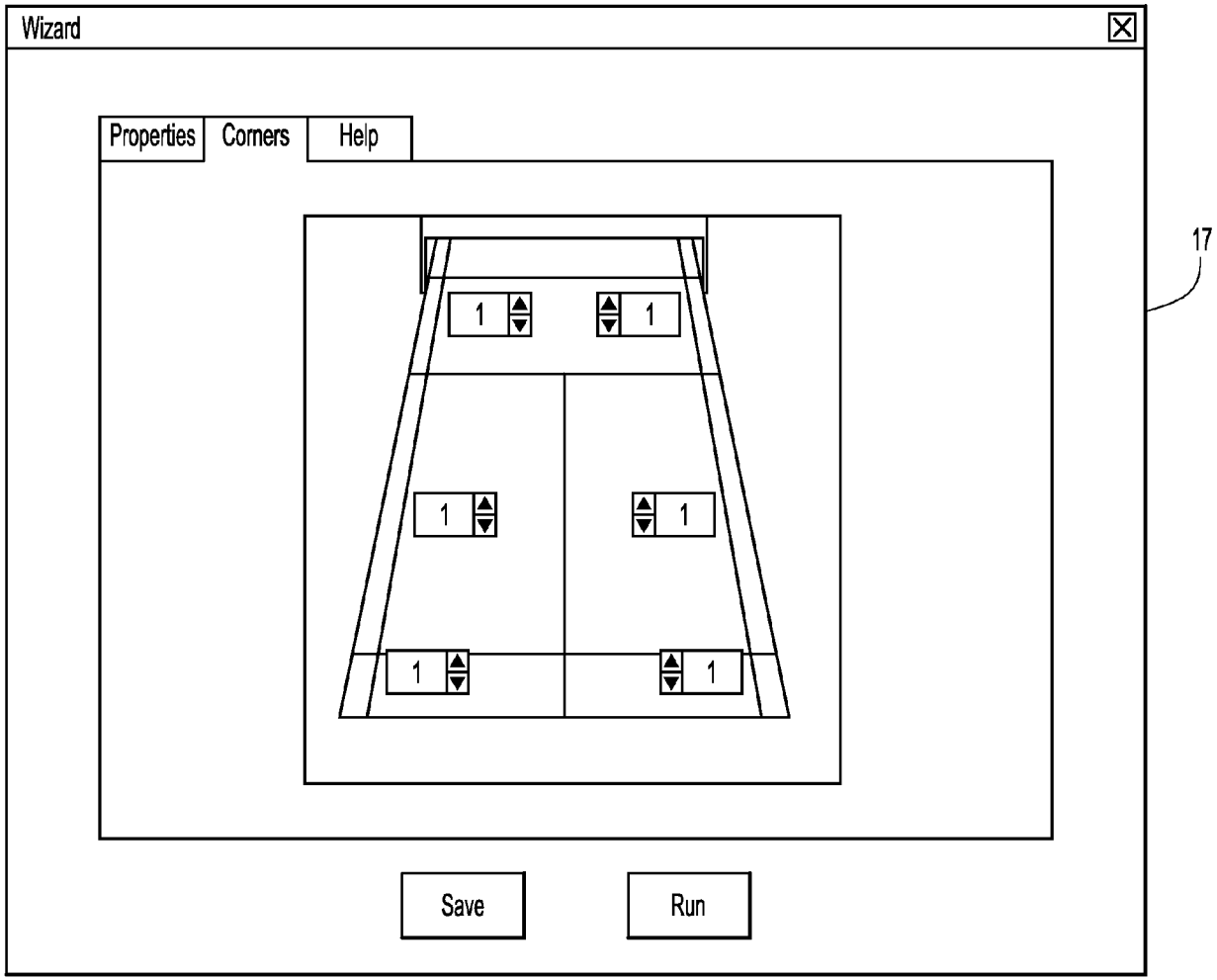
FIG. 22 is a schematic diagram of the set wizard screen with the corners tab selected by a user.

As mentioned above, the system for helping athletes, particularly badminton players, improve footwork and conditioning further includes a Set Wizard button 16 (see FIG. 4) which when clicked pulls up the set wizard screen 17 shown in FIG. 21. A user (player, coach or trainer) may use the Set Wizard button 16 to quickly and easily create a simple training module containing a single training session and set. The numerical values shown within the windows on the set wizard screen of FIG. 21 are a reduced set of numbers found in the Editor (see FIG. 15). As may be seen in FIGS. 21 and 22, the set wizard screen 17 includes multiple tabs, such as a "properties" tab and a "corners" tab, as well as Save and Run buttons. Under the "properties" tab, the user can change the default settings for four properties of a set (see FIG. 21). Specifically, the user can adjust the display speed of the arrow, the number of times the set is run, the length of the set work portion, and the duration of the rest period. These are the same properties previously described as part of the Editor shown in FIG. 15. Under the "corners" tab, the user can change the default settings for the number of times the direction indictor arrow 34 is sent to any of the six corners as previously described above with respect to FIG. 15. If the user presses the Save button, the set will be saved in a training module named "Wizard." If the user presses the Run button, the set wizard screen closes and the user is taken to the system's main screen 10 (see FIG. 5). At this point, the user only needs to press the start button 20 to run the simplified training module.

Figure 23:
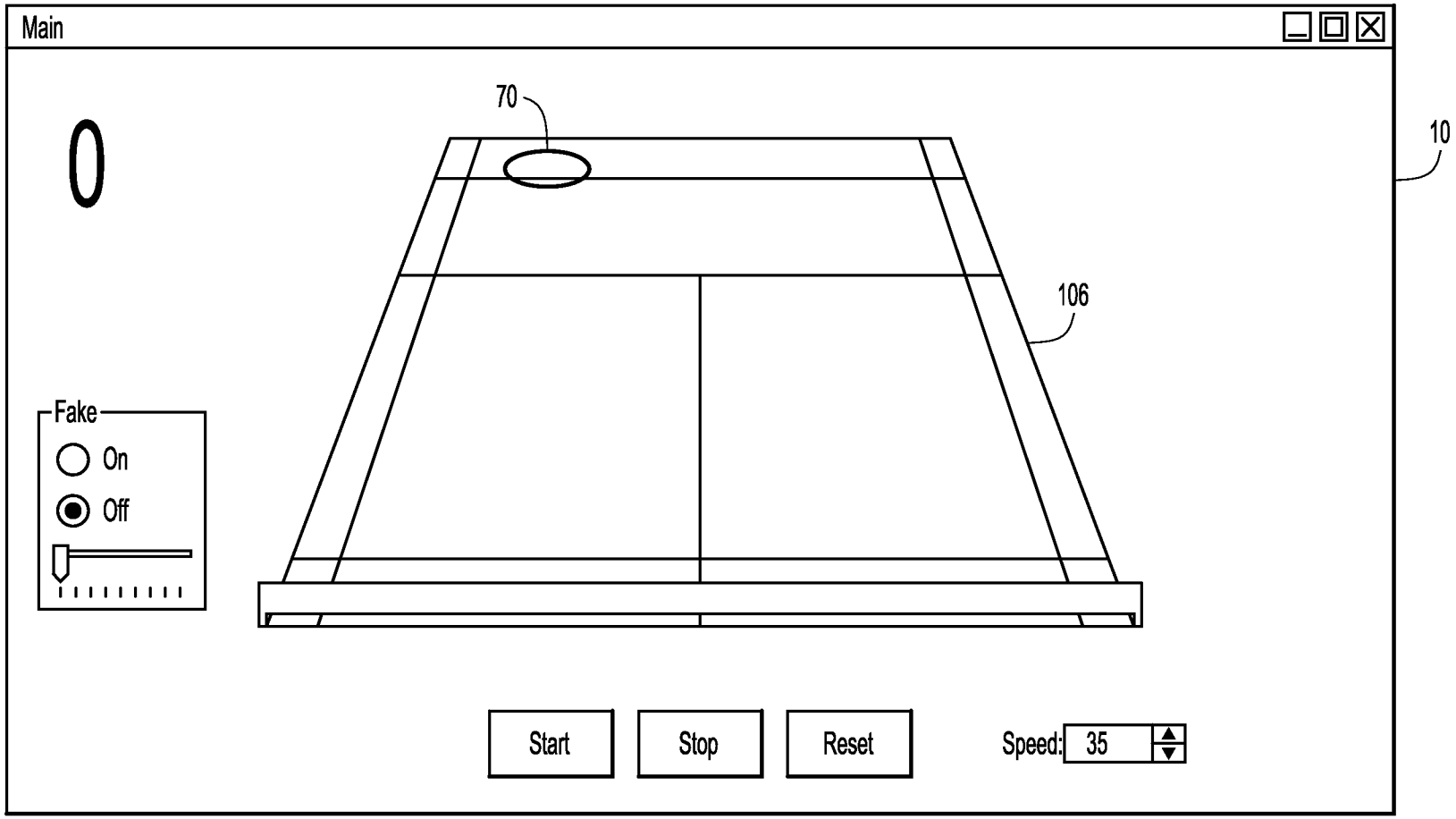
FIGS. 23-25 are schematic diagrams of the main screen illustrating an opposing badminton court with an oval indicator appearing in one of the six corners of the court.
Figure 24:
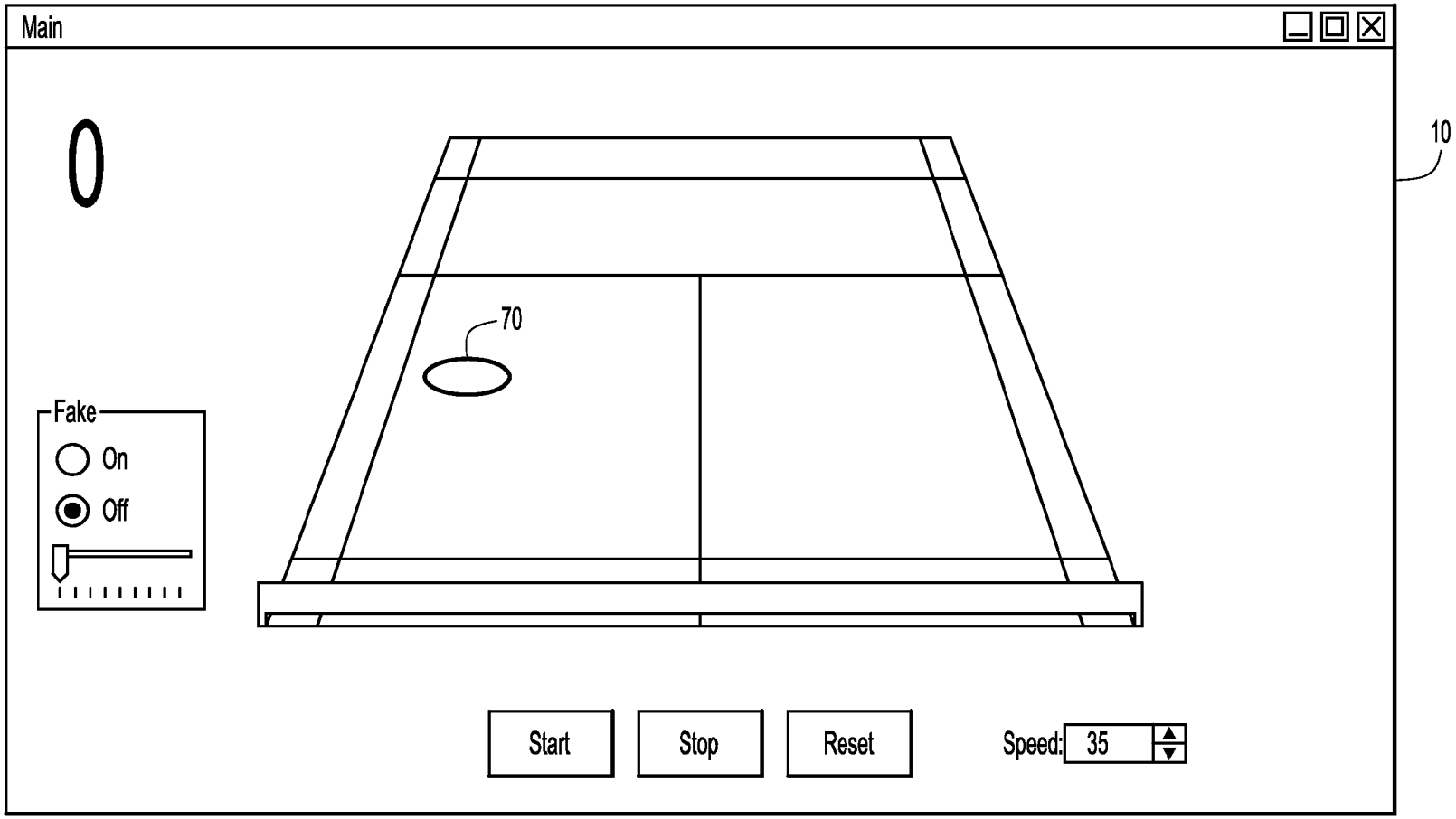
Figure 25:
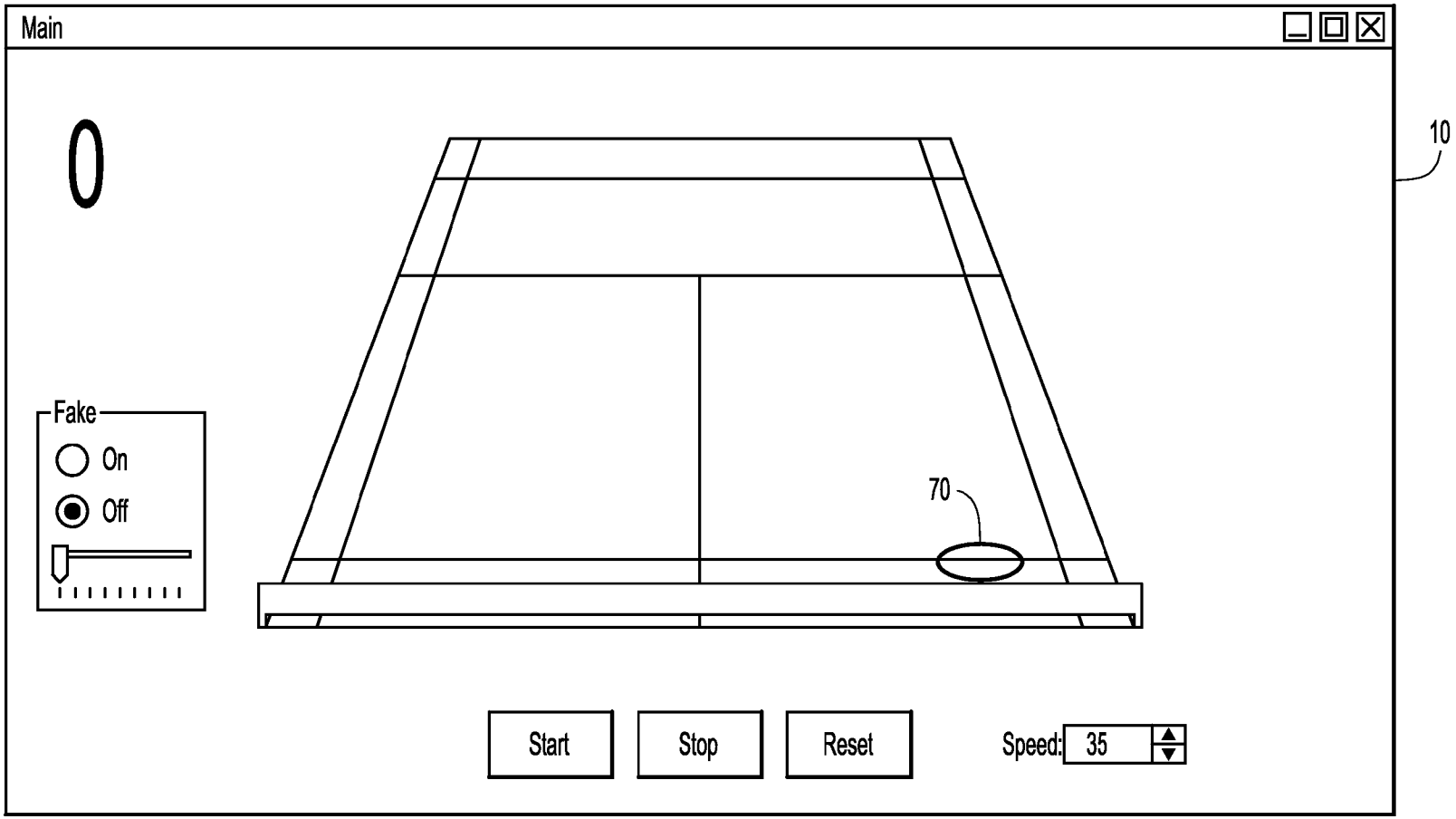

During competition, badminton players often fall into predictable patterns of play. In one situation, for instance, a player will always play one or two particular return shots. Even while training or practicing, a player will typically rely on just a few safe returns. Thus, a "Target Practice" feature has been included in the training and conditioning system of the present invention. In this feature of the system, an opposing badminton court 106 is displayed on the main screen 10 with an indicator 70 that randomly appears in any of the six corners of the opposing badminton court 106 as shown in FIGS. 23-25. Preferably the indicator is a red oval. However, in lieu of a red oval, the indicator may be any other suitable shape and color, such as a blue triangle or a yellow square. When using this feature of the invention, the player is required to return a fed shuttlecock or bird (e.g., fed by a coach, a trainer or another player) to the area of the opposing court in which the oval indicator 70 appears. The unpredictable random appearance of the oval indicator takes a player out of his/her comfort zone and forces the player to play shots he/she would otherwise not consider playing during competition. Additionally, the "Target Practice" feature of the invention helps players to quickly and easily learn to find a fed bird in flight, look at the opposing court to pick up the corner in which the oval indicator appears, and then acquire the bird already in flight and play it to the correct corner spot.

Figure 26:
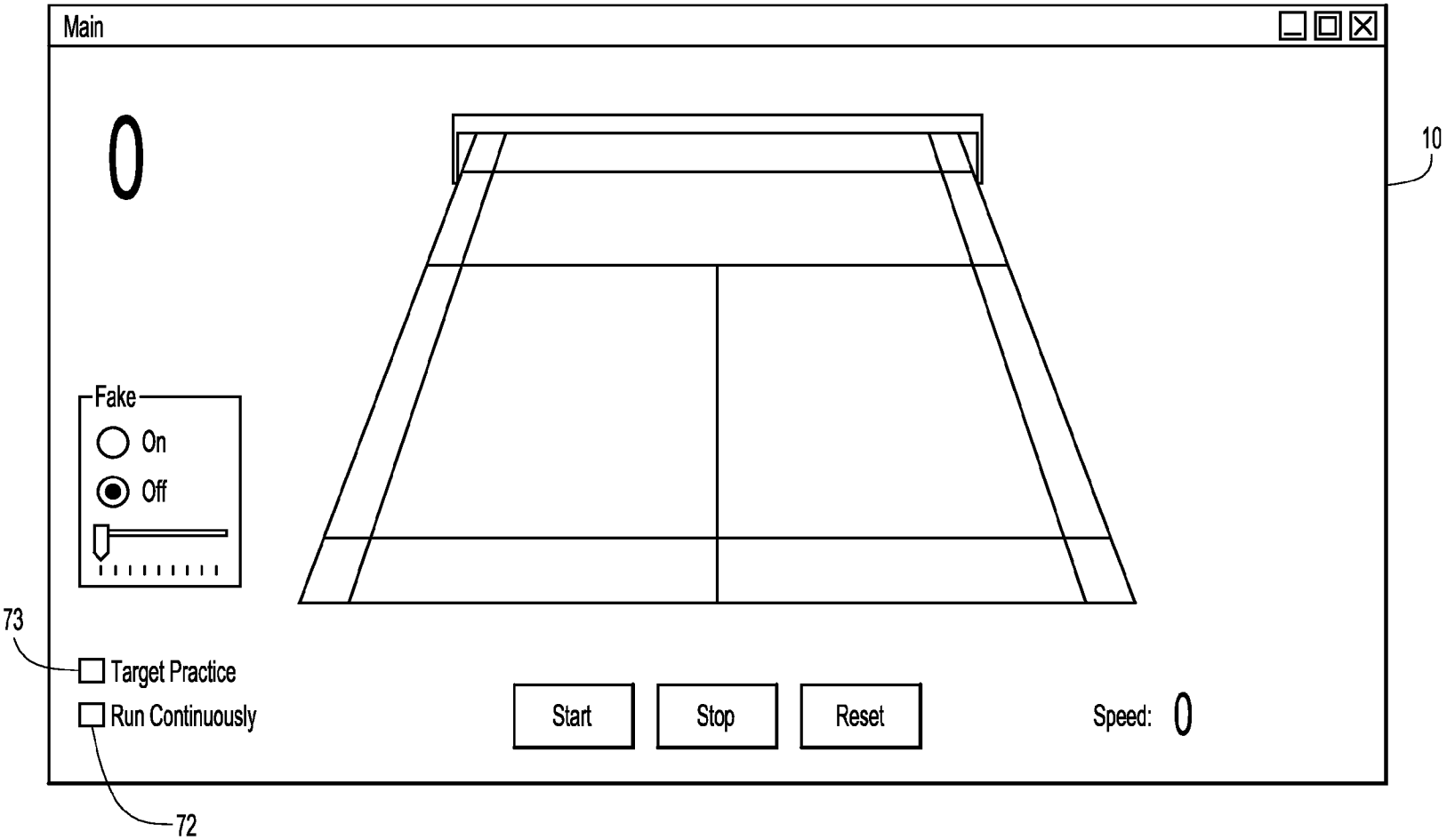
FIG. 26 is a schematic diagram of the main screen of FIG. 5 with a "run continuously" and a "target practice" box displayed in the lower left corner of the screen.

On many occasions, a coach or trainer may find themselves training dozens of badminton players on a one-on-basis over an extended period of time, e.g., when conducting a badminton summer camp. In order to avoid repeatedly restarting the system at the conclusion of a session/set of the training module, the main screen 10 may be provided with a "run continuously " box 72 in the lower left corner of the main screen 10 to enable the system to run continuously (see FIG. 26). When this box is checked, for instance, by a coach or trainer clicking the box via a left mouse click, the system will continuously run the session/set of the training module for an extended period of time, e.g., 2+ hours or until someone turns this feature off. The main advantage of this feature is it eliminates the need for the coach or trainer to repeatedly go back to the computer and restart the training module by pushing (clicking) the start button 20 every few minutes. Thus, coaches and trainers can focus their attention on improving a player's footwork and conditioning without being distracted by the need to restart the training module's session/set every few minutes.

As discussed above, the athletic system of the present invention helps athletes, particularly badminton players, develop their badminton skills by displaying training modules which may include multiple sessions and multiple sets per sessions. For instance, one session/set of the training module may be operated in an "arrow" mode (see FIG. 7) to help players learn to change direction quickly while maintaining stability and controlling their center of gravity, and another session/set may be operated in a "target practice" mode (see FIGS. 23-25) to help players quickly and easily learn to find a fed bird in flight, look at the opposing court to pick up the corner in which the oval indicator appears, and then acquire the bird already in flight and play it to the correct corner spot. To improve overall skill level, badminton players must repeatedly practice skill development in both of these modes. Hence, to enable a user (i.e., player, coach or player) to quickly and easily switch between modes, the main screen 10 of the system may also include a "target practice" box 73 in the lower left corner of the main screen 10 (see FIG. 26). When this box is checked, for instance, by a player, coach or trainer clicking the box via a left mouse click, the system immediately changes the main screen from the "arrow" mode (FIG. 7) to the "target practice" mode (FIGS. 23-25). When the "target practice" box is unchecked, the system immediately changes the main screen 10 back to the "arrow" mode. One advantage of this feature is that it enables players, coaches and trainers to repeatedly switch between training modes quickly and easily with a single mouse click. Moreover, if both the "target practice" and the "run continuously" boxes are simultaneously checked by a user, the system will continuously run the session/set of the training module in the "target practice" mode for an extended period of time, e.g., 2+ hours or until someone unchecks the "continuously run" box. The advantage of simultaneously checking both the "target practice" box and the "run continuously" box is it eliminates the need for the coach or trainer to repeatedly go back to the computer and restart the training module in "target practice" mode by pushing (clicking) the start button 20 every few minutes. Thus, coaches and trainers can focus their attention on improving a player's skills in "target practice" mode without being distracted by the need to restart the training module's session/set every few minutes.

Figure 27:
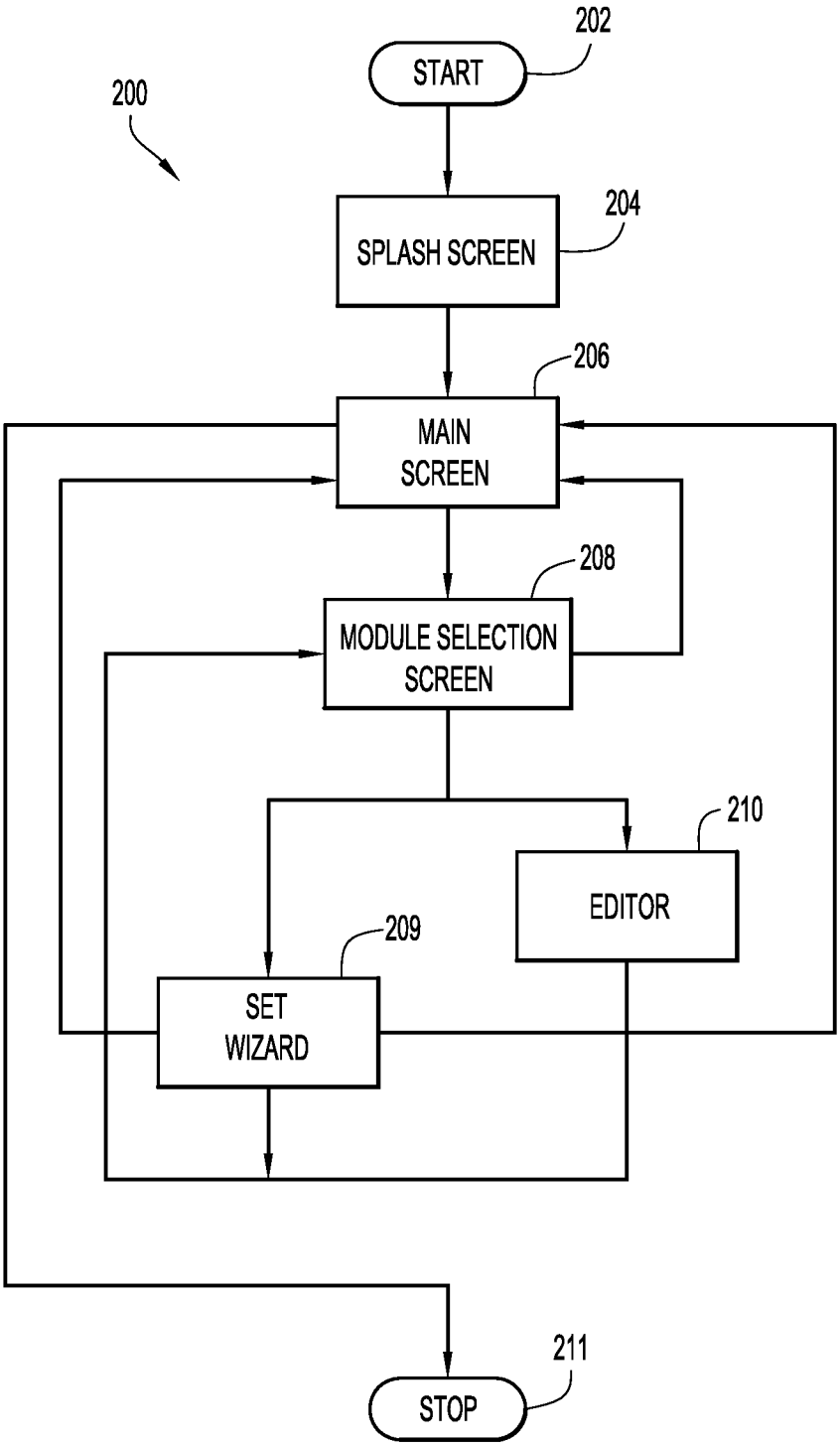
FIG. 27 is a flowchart of a training method executed on a portable computing device in accordance with embodiments of the present invention.

FIG. 27 is a flowchart of a method 200 executed on a portable computing device in accordance with an embodiment of the present invention. In step 202, the software program for improving footwork and conditioning of a badminton player is selected and initialized. At step 204, a splash page is displayed. Then, at step 206, in response to closing of the splash page, the system's main screen 10 is opened. Thereafter, at step 208, the system's training module selection screen 12 opens and is superimposed on the main screen 10. The training module selection screen 12 includes a list 14 of previously saved training modules, as well as a Set Wizard button 16. Next, in step 209, a user presses the Set Wizard button 16 to create a simple training module with a single session/set. The simple training module is thereafter run on the system's main screen 10. However, in step 210, a user may (1) select a previously saved training module from the list 14 of training modules displayed on the module selection screen 12, and open/run it or, in the alternative, modify/run it on the system's main screen 10; or (2) create a new training module and open/run it on the system's main screen. At step 211, upon the user completing the last set in the last session of the selected training module, the training module closes and the system stops running.

In addition to the features discussed above, the computer system for improving footwork and conditioning of a badminton player (athlete) may include two other features. One feature is the capture and storage of training data after a training session has been completed. This information can be displayed as a report for coaches and trainers to monitor an athlete's progress. The other feature is the playing of sounds which inform a badminton player when he/she should have finished an attack. When the system displays a direction indictor arrow to a corner of the badminton court, the player should be fast enough to finish an attack to that corner within a specified amount of time—usually within milliseconds. After the system displays an arrow, it waits a specified number of milliseconds before making a sound. The player should have completed the attack by that time and returned to a home position.

It should be understood that the system of the present invention is not restricted to use by badminton players to improve their footwork and conditioning. On the contrary, the system of this invention can be applied and can be of benefit to any athlete who participates in any other sport and needs to improve his/her footwork and conditioning, e.g., football, soccer, basketball, etc. Also, while the present invention has been described in a form particularly related to badminton where sudden starts and abrupt changes in direction at maximum output of physical energy are particularly applicable, it should be understood that the multifunctional capability of the invention can be used in many instances for other sports training as well.

Furthermore, while the present invention has been described at some length and with some particularly with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

Having described preferred embodiments of a new and improved computer software system which helps badminton players improve their footwork and conditioning, it is believed that other modifications, variations, and changes will be suggested to those skilled in the art in view of the teachings set forth herein. It is therefore to be understood that all such variations, modifications, and changes are believed to fall within the scope of the invention as defined by the appended claims. Although specific terms are employed herein, they are used in a generic and descriptive sense only and not for purposes of limitation.

What is claimed is:

1. A method for training an athlete comprising:

displaying an image of a badminton court having multiple corners on a display device;

displaying an image of an opposing badminton court having multiple corners on the display device;

obtaining a training module for the athlete from a portable computing device for display on the display device;

with a processor and a memory of the portable computing device, superimposing a direction indicator symbol included in the training module at any one of the corners of the displayed image of the badminton court;

selectively moving the direction indicator symbol either randomly or in a sequence from one corner of the badminton court image to another corner of the court image in rapid succession to assist the athlete practice footwork and conditioning drills; and displaying an indicator included in the training module such that it randomly appears at any of the corners of the opposing badminton court image, the random appearance of the indicator at any one of the corners designating an area of the opposing court the athlete is required to return a fed bird.

2. The method of claim 1, wherein displaying the image of a badminton court comprises:

displaying the image on a display of the portable computing device.

3. The method of claim 1, wherein displaying the image of a badminton court comprises:

displaying the image on a separate display in wired or wireless communication with the portable computing device.

4. The method of claim 1, wherein obtaining the training module for the athlete comprises:

accessing a previously stored training module from at least one of a local or an external storage location.

5. The method of claim 4, wherein accessing a previously stored training module comprises:

selecting a training module from a displayed list of training modules previously stored at the at least one local or external storage location.

6. The method of claim 5, wherein selecting the training module from the displayed list of previously stored training modules comprises:

selecting from training modules designed for specific athletes, warmup training modules or group training modules.

7. The method of claim 6, wherein the training modules have one or more sessions and one or more sets per session, and selecting the training module from the displayed list of previously stored training modules further comprises:

selecting one or more sessions and/or one or more sets per session.

8. The method of claim 7, wherein the selecting one or more sessions and/or one or more sets per session further comprises:

configuring a counter of the selected one or more sessions to operate in one of a count down by seconds mode or a count up by repletion mode, and setting the number of times the selected one or more sets per session runs and the duration of work and rest periods for the selected one or more sets.

9. The method of claim 1, wherein obtaining the training module for the athlete comprises:

creating at least one new training module on the portable computing device to assist the athlete practice footwork and conditioning drills.

10. The method of claim 1, wherein superimposing the direction indictor symbol at any one of the corners of the displayed image of the badminton court comprises:

superimposing a direction indicator arrow representing a fake at any one of the corners of the displayed image of the badminton court.

11. The method of claim 10, wherein superimposing the direction indicator arrow representing a fake at any one of the corners of the displayed image of the badminton court further comprises:

displaying a fake controller including radio buttons and a slider to permit a user to turn the fake on and off and control the fake speed, and displaying a speed selector to control how rapidly the arrow changes directions from one corner to another corner of the badminton court image.

12. The method of claim 11, wherein the arrow representing a fake indicates a direction in which a player practicing footwork and conditioning drills is to move, and wherein the arrow may be one of a first and second color, the first color indicating that the player is to play a bird high and the second color indicating that the player is to play a bird low.

13. The method of claim 1, wherein selectively moving the direction indicator symbol either randomly or in a predetermined sequence from one corner of the court image to another corner of the court image in rapid succession further comprises:

displaying a first control to permit a user to select random or sequence movement of the direction indictor symbol, and displaying a second control to allow the user to enter numerical values in windows at the corners of the image of the badminton court, wherein the numerical values entered into each of the corner windows when the user selects random movement indicate the relative number of times the direction indictor symbol points to that corner, and the numerical values entered into each of the windows when the user selects sequence movement indicate the order in which the direction indicator symbol points to that particular corner.

14. The method of claim 13, wherein, when random movement is selected by the user, the numerical values entered into each of the corner windows range from zero to any higher numerical value and, when sequence movement is selected by the user, the numerical values entered into each of the windows range from zero to six.

15. The method of claim 1, further comprising:

displaying a control to run a session and a set of the training module continuously, and selecting said control to run the session and the set of the training module continuously to avoid repeatedly restarting the training module every few minutes.

16. One or more non-transitory computer readable storage media encoded with software comprising computer executable instructions and when the software is executed operable to:

display an image of a badminton court having multiple corners on a display of a portable computing device;

obtain a training module for an athlete from the portable computing device for display on the display device;

superimpose a direction indicator arrow representing a fake included in the training module at any one of the corners of the displayed image of the badminton court; and selectively move the arrow representing a fake either randomly or in a predetermined sequence from one corner of the badminton court image to another corner of the court image in rapid succession to assist the athlete practice footwork and conditioning drills.

17. The computer readable storage media of claim 16, wherein the instructions operable to obtain a training module for an athlete comprise instructions operable to:

access a previously stored training module from at least one of a local or an external storage location, and select a training module from a displayed list of training modules previously stored at the at least one local or external storage location.

18. The computer readable storage media of claim 16, wherein the instructions operable to superimpose a direction indicator arrow representing a fake at any one of the corners of the displayed image of the badminton court comprise instructions operable to:

display a fake controller including radio buttons and a slider to permit a user to turn the fake on and off and control the fake speed, display a speed selector to control how rapidly the arrow changes directions from one corner to another corner of the badminton court image, and display the arrow as one of a first and second color, the first color indicating that a player is to play a bird high and the second color indicating that the player is to play a bird low.

19. The computer readable storage media of claim 16, wherein the instructions operable to selectively move the arrow representing a fake either randomly or in a predetermined sequence from one corner of the court image to another corner of the court image in rapid succession comprise instructions operable to:

display a first control to permit a user to select random or sequence movement of the direction indicator arrow, and display a second control to allow the user to enter numerical values in windows at the corners of the image of the badminton court, wherein the numerical values entered into each of the corner windows when the user selects random movement indicate the relative number of times the direction indicator symbol points to that corner, and the numerical values entered into each of the windows when the user selects sequence movement indicate the order in which the direction indicator symbol points to that particular corner.

20. A method for skill development of a badminton player comprising:

displaying an image of a badminton court having multiple corners on a display device;

displaying an image of an opposing badminton court having multiple corners on a display device;

selecting from a portable computing device for display on the display device a training module having practice sessions and sets for skill development of the player;

with a processor and a memory of the portable computing device, superimposing an indicator arrow representing a fake included in the training module at any one of the corners of the displayed image of the badminton court, said arrow indicating a direction in which the player practicing fake skill development is to move;

selectively moving the indicator arrow either randomly or in a sequence from one corner of the badminton court image to another corner of the court image in rapid succession to enhance fake skill development of the player, and superimposing a geometric symbol included in the training module randomly at any of the corners of the displayed image of the opposing badminton court, said symbol indicating an area of the opposing court in which the player is to return a fed bird.

21. The method of claim 20, further comprising:

displaying a control which permits a user to immediately switch practice sessions and sets of the training module from a mode in which the indictor arrow is superimposed on the image of the badminton court to a mode in which the geometric symbol is superimposed on the image of the opposing badminton court, and selecting said control to immediately switch the practice sessions and sets from the mode in which the indictor arrow is superimposed on the image of the badminton court to the mode in which the geometric symbol is superimposed on the image of the opposing badminton court.

* * * * *